US010586548B2

(12) United States Patent
Baeckstroem et al.

(10) Patent No.: US 10,586,548 B2
(45) Date of Patent: Mar. 10, 2020

(54) ENCODER, DECODER AND METHOD FOR ENCODING AND DECODING

(71) Applicant: Fraunhofer-Gesellschaft zur Foerderung der angewandten Forschung e.V., Munich (DE)

(72) Inventors: Tom Baeckstroem, Helsinki (FI); Johannes Fischer, Eggolsheim (DE); Christian Helmrich, Berlin (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 74 days.

(21) Appl. No.: 15/256,996

(22) Filed: Sep. 6, 2016

(65) Prior Publication Data

US 2016/0372128 A1 Dec. 22, 2016

Related U.S. Application Data

(63) Continuation of application No. PCT/EP2015/054396, filed on Mar. 3, 2015.

(30) Foreign Application Priority Data

Mar. 14, 2014 (EP) ..... 14159811
Aug. 22, 2014 (EP) ..... 14182047

(51) Int. Cl.
*G10L 19/00* (2013.01)
*G10L 19/16* (2013.01)
(Continued)

(52) U.S. Cl.
CPC ..... *G10L 19/167* (2013.01); *G10L 19/028* (2013.01); *G10L 19/0212* (2013.01);
(Continued)

(58) Field of Classification Search
CPC ..... G10L 19/107; G10L 2019/0001; G10L 19/038; G10L 19/10; G10L 2019/0003;
(Continued)

(56) References Cited

U.S. PATENT DOCUMENTS 4,868,867 A * 9/1989 Davidson ..... G10L 19/10 704/200.1
5,495,556 A 2/1996 Honda
(Continued)

FOREIGN PATENT DOCUMENTS

CN 1222997 A 7/1999
CN 101091208 A 12/2007
(Continued)

OTHER PUBLICATIONS

Backstrom et al., ("Decorrelated Innovative Codebooks for ACELP Using Factorization of Autocorrelation Matrix", Interspeech 2014, pp. 2794-2798). (Year: 2014).*
(Continued)

*Primary Examiner* — Vijay B Chawan
(74) *Attorney, Agent, or Firm* — Michael A. Glenn; Perkins Coie LLP

(57) ABSTRACT

An encoder for encoding an audio signal has a predictor, a factorizer, a transformer and a quantize and encode stage. The predictor is configured to analyze the audio signal to obtain prediction coefficients describing a spectral analog of the audio signal or a fundamental frequency of the audio signal and subject the audio signal to an analysis filter function dependent on the prediction coefficients to output a residual signal of the audio signal. The factorizer is configured to apply a matrix factorization onto an audiocorrelation or covariance matrix of synthesis filter function defined by the prediction coefficients to obtain factorized matrices. The transformer is configured to transform the residual signal
(Continued)

based on the factorized matrices to obtain a transformed residual signal. The quantize and decode stage is configured to quantize the transformed residual signal to obtain a quantized transformed residual signal or an encoded quantized transformed residual signal.

23 Claims, 7 Drawing Sheets

(51) Int. Cl.

| | |
|---|---|
| ***G10L 19/038*** | (2013.01) |
| ***G10L 19/107*** | (2013.01) |
| ***G10L 19/08*** | (2013.01) |
| ***G10L 19/02*** | (2013.01) |
| ***G10L 19/028*** | (2013.01) |
| ***G10L 19/032*** | (2013.01) |

(52) U.S. Cl.
CPC ..... *G10L 19/032* (2013.01); *G10L 19/038* (2013.01); *G10L 19/08* (2013.01); *G10L 19/107* (2013.01)

(58) Field of Classification Search
CPC ..... G10L 2019/0004; G10L 2019/0008; G10L 2019/0014; G10L 2021/02082; G10L 2021/02166; G10L 21/0208; G10L 25/06; G06F 17/18; H04B 7/0697; H04B 7/0854; H94R 2430/03
USPC .... 704/220, 222, 223, 500–504, 200.1, 219, 704/201, 230
See application file for complete search history.

(56) References Cited

U.S. PATENT DOCUMENTS

| | | | | |
|---|---|---|---|---|
| 5,717,825 | A * | 2/1998 | Lamblin | G10L 19/107 704/223 |
| 6,826,526 | B1 | 11/2004 | Norimatsu et al. | |
| 7,065,486 | B1 | 6/2006 | Thyssen et al. | |
| 10,170,129 | B2 * | 1/2019 | Baeckstroem | G10L 19/107 |
| 2007/0219763 | A1 * | 9/2007 | Smith | G06F 17/18 703/2 |
| 2007/0253496 | A1 * | 11/2007 | Giannakis | H04L 1/0041 375/260 |
| 2008/0010072 | A1 | 1/2008 | Yoshida et al. | |
| 2008/0317141 | A1 * | 12/2008 | Burg | H04B 7/0854 375/260 |
| 2009/0117862 | A1 * | 5/2009 | Le Nir | H04B 7/0697 455/101 |
| 2012/0078641 | A1 | 3/2012 | Qi et al. | |
| 2014/0126745 | A1 * | 5/2014 | Dickins | H04R 3/002 381/94.3 |
| 2015/0213810 | A1 * | 7/2015 | Baeckstroem | G10L 19/107 704/222 |
| 2018/0218743 | A9 * | 8/2018 | Baeckstroem | G10L 19/107 |
| 2019/0115035 | A1 * | 4/2019 | Baeckstroem | G10L 19/107 |

FOREIGN PATENT DOCUMENTS

| | | | |
|---|---|---|---|
| CN | 101609680 | A | 12/2009 |
| EP | 1396841 | B1 | 2/2008 |
| JP | 2005283692 | A | 10/2005 |
| JP | 2005530205 | A | 10/2005 |
| RU | 2009143665 | A | 7/2011 |
| RU | 2439721 | C2 | 1/2012 |
| WO | 03107328 | A1 | 12/2003 |
| WO | 2012144128 | A1 | 10/2012 |
| WO | 2014001182 | A1 | 1/2014 |

OTHER PUBLICATIONS

Zhou, "A modified low-bit-rate ACELP speech coder and its implementation—A modified low-bit-rate ACELP speech coder and its implementation", 2003, Thesis Concordia University, pp. 1-98 (Year: 2003).*

ISO/IEC FDIS 23003-3:2011(E), "Information technology—MPEG audio technologies—Part 3: Unified speech and audio coding", ISO/IEC JTC 1/SC 29/WG 11, Sep. 20, 2011, 291 pages.

Adoul, et al., "Fast CELP coding based on algebraic codes", Acoustics, Speech, and Signal Processing, IEEE International Conference on ICASSP'87., vol. 12. IEEE, Apr. 6-9, 1987, pp. 1957-1960.

BäCKSTRöM, et al., "Implementation and evaluation of the Vandermonde transform", Submitted to EUSIPCO 2014 (22nd European Signal Processing Conference 2014) (EUSIPCO 2014), Lisbon, Portugal, Sep. 2014., 6 pages.

BäCKSTRöM, T. , "Computationally efficient objective function for algebraic codebook optimization in ACELP", Aug. 2013, 5 pages.

BäCKSTRöM, Tom , "Vandermonde Factorization of Toeplitz Matrices and Applications in Filtering and Warping", IEEE Transactions on Signal Processing, vol. 61, No. 24, Dec. 15, 2013, pp. 6257-6263.

Bessette, B et al., "The Adaptive Multirate Wideband Speech Codec (AMR-WB)", IEEE Transactions on Speech and Audio Processing, IEEE Service Center. New York. vol. 10, No. 8., Nov. 2002, pp. 620-636.

Byun, et al., "A fast ACELP codebook search method", Signal Processing, 2002 6th International Conference on, vol. 1. IEEE, 2002, Aug. 26-30, 2002, pp. 422-425.

Chen, et al., "Maximum-take-precedence ACELP: a low complexity search method", Acoustics, Speech, and Signal Processing, 2001. Proceedings.(ICASSP'01). 2001 IEEE International Conference on, vol. 2. IEEE, May 7-11, 2001, pp. 693-696.

Golub, et al., "Matrix Computations", Johns Hopkins Univ Press, Oct. 15, 1996, 367 pages.

Ha, et al., "A fast search method of algebraic codebook by reordering search sequence", Acoustics, Speech, and Signal Processing, 1999. Proceedings., 1999 IEEE International Conference on, vol. 1. IEEE, 1999, Mar. 15-19, 1999, pp. 21-24.

Hermus, et al., "A review of signal subspace speech enhancement and its application to noise robust speech recognition", EURASIP Journal on Applied Signal Processing, vol. 2007, No. 1;, First Online: Sep. 13, 2006, pp. 195-195.

ITU-T, G.718 , "Frame Error Robust Narrow-Band and Wideband Embedded Variable Bit-Rate Coding of Speech and Audio from 8-32 kbit/s", Series G: Transmission System and Media, Digital Systems and Networks, Recommendation ITU-T G.718, Telecommunication Standardization Sector of ITU, Jun. 2008, 257 pages.

Laamme, C. et al., "On Reducing Computational Complexity of Codebook Search in CELP Coder Through the Use of Algebraic Codes", in Acoustics, Speech, and Signal Processing, 1990. ICASSP-90., 1990 International Conference on. IEEE, Apr. 3-6, 1990, pp. 177-180.

Neuendorf, et al., "Unified Speech and Audio Coding Scheme for High Quality at Low Bitrates", IEEE Int'l Conference on Acoustics, Speech and Signal Processing, Apr. 19, 2009, pp. 1-4.

Ramirez, et al., "Efficient algebraic multipulse search", Telecommunications Symposium, 1998. ITS'98 Proceedings. SBT/IEEE International. IEEE, 1998, Aug. 9-13, 1998, pp. 231-236.

Moriya, "10.3 Improvements on Excitation Vector Search, 10.3.1 Correlation, Frequency Domain Search, and Audio Encoding", The Institute of Electronics, Information and Communication Engineers, first edition, Oct. 20, 1998,, pp. 96-99.

* cited by examiner

ENCODER, DECODER AND METHOD FOR ENCODING AND DECODING

CROSS-REFERENCE TO RELATED APPLICATIONS

This application is a continuation of copending International Application No. PCT/EP2015/054396, filed Mar. 3, 2015, which is incorporated herein by reference in its entirety, and additionally claims priority from European Application No. 14159811.0, filed Mar. 14, 2014, and from European Application No. 14182047.2, filed Aug. 22, 2014, wherein each are incorporated herein in its entirety by this reference thereto.

BACKGROUND OF THE INVENTION

Embodiments of the present invention refer to an encoder for encoding an audio signal to obtain a data stream and to a decoder for decoding a data stream to obtain an audio signal. Further embodiments refer to the corresponding method for encoding an audio signal and for decoding a data stream. A further embodiment refers to a computer program performing the steps of the methods for encoding and/or decoding.

The audio signal to be encoded may, for example, be a speech signal; i.e. the encoder corresponds to a speech encoder and the decoder corresponds to a speech decoder. The most frequently used paradigm in speech coding is algebraic code excited linear prediction (ACELP) which is used in standards such as the AMR-family, G.718 and MPEG USAC. It is based on modeling speech using a source model, consisting of a linear predictor (LP) to model the spectral envelope, a long time predictor (LTP) to model the fundamental frequency and an algebraic codebook for the residual. The codebook parameters are optimized in a perceptually weighted synthesis domain. The perceptual model is based on the filter, whereby the mapping from the residual to the weighted output is described by a combination of linear predictor and the weighted filter.

The largest portion of the computational complexity in ACELP codecs is spent on choosing the algebraic codebook entry, which is on quantization of the residual. The mapping from the residual domain to the weighted synthesis domain is essentially a multiplication by a matrix of size N×N, wherein N is the vector length. Due to this mapping, in terms of weighted output SNR (signal to noise ratio), residual samples are correlated and cannot be quantized independently. It follows that every potential codebook vector has to be evaluated explicitly in weighted synthesis domain to determine the best entry. This approach is known as the analysis-by-synthesis algorithm. Optimal performance is possible only with a brute-force search of the codebook. The codebook size depends on the bit-rate but given a bit-rate of B, there are $2^8$ entries to evaluate for a total complexity of $O(2^6 N^2)$, which clearly unrealistic when B is larger or equal to 11. In practice codecs therefore employ non-optimal quantizations that balance between complexity and quality. Several of these iterative algorithms for finding the best quantization which limit complexity at the cost of accuracy have been presented. To overcome this limitation, a new approach is needed.

SUMMARY

According to an embodiment, an encoder for encoding an audio signal into a data stream may have: a predictor configured to analyze the audio signal in order to obtain prediction coefficients describing a spectral envelope of the audio signal or a fundamental frequency of the audio signal and to subject the audio signal to an analysis filter function dependent on the prediction coefficients in order to output a residual signal of the audio signal; a factorizer configured to apply a matrix factorization onto an autocorrelation or covariance matrix of a synthesis filter function defined by the prediction coefficients to obtain factorized matrices; a transformer configured to transform the residual signal based on the factorized matrices to obtain a transformed residual signal; and a quantize and encode stage configured to quantize the transformed residual signal to obtain a quantized transformed residual signal and having an entropy encoder having an input for the prediction coefficients and configured to entropy encode the quantized transformed residual signal with detecting the probability based on the prediction coefficients to obtain an encoded quantized transformed residual signal.

According to another embodiment, a method for encoding an audio signal into a data stream may have the steps of: analyzing the audio signal in order to obtain prediction coefficients describing the spectral envelope of the audio signal or a fundamental frequency of the audio signal and subjecting the audio signal to an analysis filter function dependent on the prediction coefficients in order to output a residual signal of the audio signal; applying a matrix factorization onto an autocorrelation or covariance matrix of a synthesis filter function defined by the prediction coefficients to obtain factorized matrices; transforming the residual signal based on the factorized matrices to obtain a transformed residual signal; and quantizing and encoding the transformed residual signal to obtain a quantized transformed residual signal and entropy encoding using the prediction coefficients the quantized transformed residual signal with detecting the probability based on the prediction coefficients to obtain an encoded quantized transformed residual signal.

Another embodiment may have using the above method in place of discrete Fourier transformation, discrete cosine transformation, modified discrete cosine transformation or another transformation in signal processing algorithms.

According to still another embodiment, a decoder for decoding a data stream into an audio signal may have: a decode stage configured to output a transformed residual signal based on an inbound encoded quantized transformed residual signal using entropy decoding with detecting the probability based on prediction coefficients describing a spectral envelope of the audio signal or a fundamental frequency of the audio signal; a retransformer configured to retransform a residual signal from the transformed residual signal based on factorized matrices representing a result of a matrix factorization of an autocorrelation or covariance matrix of a synthesis filter function defined by the prediction coefficients; and a synthesis stage configured to synthesize the audio signal based on the residual signal by using the synthesis filter function defined by the prediction coefficients.

According to another embodiment, a method for decoding a data stream into an audio signal may have the steps of: outputting a transformed residual signal based on an inbound encoded quantized transformed residual signal using entropy decoding with detecting the probability based on prediction coefficients describing a spectral envelope of the audio signal or a fundamental frequency of the audio signal; applying a matrix factorization onto an autocorrelation or covariance matrix of a synthesis filter function defined by prediction coefficients; describing a spectral envelope of the audio signal or a fundamental frequency of the audio signal to obtain factorized matrices; retransforming a residual signal from the retransformed residual signal based on the factorized matrices; and synthesizing the audio signal based on the residual signal by using the synthesis filter function defined by the prediction coefficients.

Another embodiment may have a non-transitory digital storage medium having stored thereon a computer program for performing a method for encoding an audio signal into a data stream, the method having the steps of: analyzing the audio signal in order to obtain prediction coefficients describing the spectral envelope of the audio signal or a fundamental frequency of the audio signal and subjecting the audio signal to an analysis filter function dependent on the prediction coefficients in order to output a residual signal of the audio signal; applying a matrix factorization onto an autocorrelation or covariance matrix of a synthesis filter function defined by the prediction coefficients to obtain factorized matrices; transforming the residual signal based on the factorized matrices to obtain a transformed residual signal; and quantizing and encoding the transformed residual signal to obtain a quantized transformed residual signal and entropy encoding using the prediction coefficients the quantized transformed residual signal with detecting the probability based on the prediction coefficients to obtain an encoded quantized transformed residual signal, when said computer program is run by a computer.

Still another embodiment may have a non-transitory digital storage medium having stored thereon a computer program for performing a method for decoding a data stream into an audio signal, the method having the steps of: outputting a transformed residual signal based on an inbound encoded quantized transformed residual signal using entropy decoding with detecting the probability based on prediction coefficients describing a spectral envelope of the audio signal or a fundamental frequency of the audio signal; applying a matrix factorization onto an autocorrelation or covariance matrix of a synthesis filter function defined by prediction coefficients; describing a spectral envelope of the audio signal or a fundamental frequency of the audio signal to obtain factorized matrices; retransforming a residual signal from the retransformed residual signal based on the factorized matrices; and synthesizing the audio signal based on the residual signal by using the synthesis filter function defined by the prediction coefficients, when said computer program is run by a computer.

According to another embodiment, a data stream having an encoded audio signal may have: a first portion having factorized matrices, resulting from a matrix factorization onto an autocorrelation or covariance matrix of a synthesis filter function defined by a prediction coefficients, and the prediction coefficients, describing a spectral envelope of the audio signal or a fundamental frequency of the audio signal; and a second portion having a residual signal of the audio signal, after subjecting the audio signal to an analysis filter function dependent on the prediction coefficients, in form of an encoded quantized transformed residual signal obtained by entropy encoding using the prediction coefficients the quantized transformed residual signal with detecting the probability based on the prediction coefficients.

The first embodiment provides an encoder for encoding an audio signal into a data stream. The encoder comprises a (linear or long time) predictor, a factorizer, a transformer and a quantized encode stage. The predictor is configured to analyze the audio signal in order to obtain (linear or long time) prediction coefficients describing a spectral envelope of the audio signal or a fundamental frequency of the audio signal and to subject the audio signal to an analysis filter function dependent on the prediction coefficients in order to output a residual signal of the audio signal. The factorizer is configured to apply a matrix factorization onto an autocorrelation or covariance matrix of a synthesis filter function defined by the prediction coefficients to obtain factorized matrices. The transformer is configured to transform the residual signal based on the factorized matrices to obtain a transformed residual signal. The quantize and encode stage is configured to quantize the transform residual signal to obtain a quantized transformed residual signal or an encoded quantized transformed residual signal.

Another embodiment provides a decoder for decoding a data stream into an audio signal. The decoder comprises a decode stage, a retransformer and a synthesis stage. The decode stage is configured to output a transform residual signal based on an inbound quantized transform residual signal or based on an inbound encoded quantized transform residual signal. The retransformer is configured to retransform a residual signal from the transformed residual signal based on the factorized matrices resulting from a matrix factorization of an autocorrelation or covariance matrix of a synthesis filter function defined by prediction coefficients describing a spectral envelope of the audio signal or a fundamental frequency of the audio signal to obtain factorized matrices. The synthesis stage is configured to synthesize the audio signal based on the residual signal by using the synthesis filter function defined by the prediction coefficient.

As can be seen on the basis of these two embodiments, the encoding and the decoding are two-stage processes, what makes this concept comparable to ACELP. The first step enables the quantization of synthetization with respect to the spectral envelope or the fundamental frequency, wherein the second stage enables the (direct) quantization or synthetization of the residual signal, also referred to as excitation signal and representing the signal after filtering the signal with the spectral envelope or the fundamental frequency of the audio signal. Also, analogously to ACELP, the quantization of the residual signal or excitation signal complies with an optimization problem, wherein the objective function of the optimization problem according to the teachings disclosed herein differs substantially when compared to ACELP. In detail, the teachings of the present invention are based on the principle that matrix factorization is used to decorrelate the objective function of the optimization problem, whereby the computational expensive iteration can be avoided and optimal performance is guaranteed. The matrix factorization, which is one central step of the enclosed embodiments, is included in the encoder embodiment and may advantageously, but not necessarily, be included in the decoder embodiment.

The matrix factorization may be based on different techniques, for example eigen value decomposition, Vandermonde factorization or any other factorization, wherein for each chosen technique the factorization factorizes is a matrix, e.g. the autocorrelation or the covariance matrix of the synthesis filter function, defined by the (linear or long time) prediction coefficients which are detected by the first audio in the first stage (linear predictor or long time predictor) of the encoding or decoding.

According to another embodiment the factorizer factorizes the synthesis filter function, comprising the prediction coefficients which are stored using a matrix, or factorizes a weighted version of the synthesis filter function matrix. For example, the factorization may be performed by using the Vandermonde matrix V, a diagonal matrix D and a transform-conjuncted version of the Vandermonde matrix V. Vandermonde matrix may be factorized using the formula R=V*DV or C=V*DV, wherein the autocorrelation matrix R or the covariance matrix C is defined by a transformed-conjuncted version of the synthesis filter function matrix H* and a regular version of the synthesis function matrix H, i.e. R=H*H or C=H*H.

According to a further embodiment, the transformer, starting from a previously determined diagonal matrix D and a previously determined Vandermonde matrix V, transforms the residual signal x to a transformed residual signal y using the formula $y=D^{1/2}Vx$ or the formula y=DVx.

According to a further embodiment, the quantize and encode stage is now able to quantize the transformed residual signal y in order to obtain the quantized transformed residual signal ŷ. This transforming is an optimization problem, as discussed above, wherein the objective function $$\eta(y) = \frac{(y * \hat{y})^2}{\|\hat{y}\|^2}$$

is used. Here, it is advantageous that this objective function has a reduced complexity when compared to objective functions used for different encoding or decoding methods, such as the objective function used within the ACELP encoder.

According to an embodiment, the decoder receives the factorized matrices from the encoder, e.g. together with the data stream, or according to another embodiment the decoder comprises an optional factorizer which performs the matrix factorization. According to an embodiment the decoder receives factorized matrices directly and deviates the prediction coefficients from these factorized matrices since the matrices have their origin in the prediction coefficients (cf. encoder). This embodiment enables to further reduce the complexity of the decoder.

Further embodiments provide the corresponding methods for encoding the audio signal into a data stream and for decoding the data stream into an audio signal. According to an additional embodiment the method for encoding as well as the method for decoding may be performed or at least partially performed by a processor such as a CPU of a computer.

BRIEF DESCRIPTION OF THE DRAWINGS

Embodiments of the present invention will be discussed referring to the enclosed drawings, wherein.

DETAILED DESCRIPTION OF THE INVENTION

Embodiments of the present invention will subsequently be discussed in detail below referring to the enclosed figures. Here, the same reference numbers are provided to objects having the same or similar function so that a description thereof is interchangeable or mutually applicable.

Figure 1A:
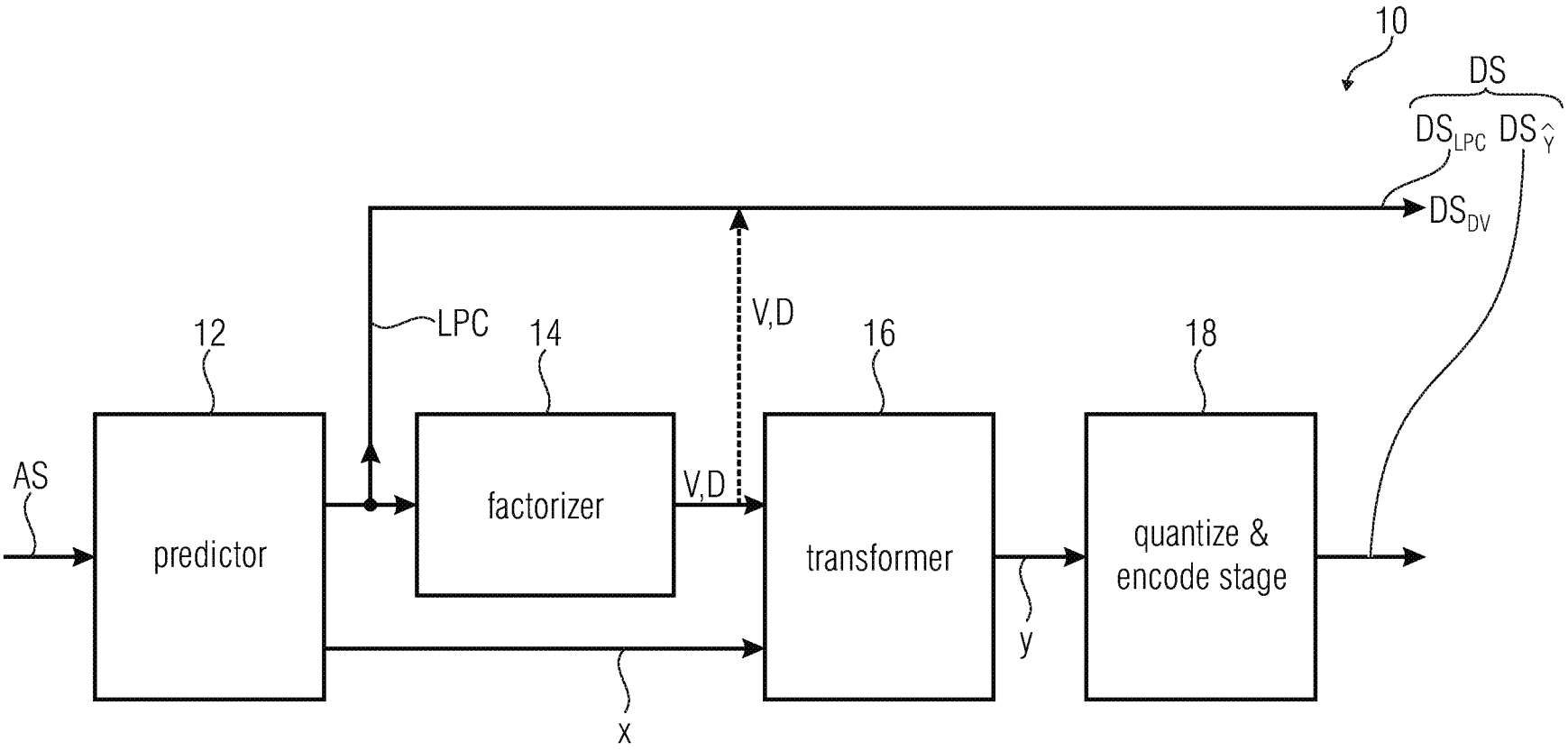
FIG. 1*a* shows a schematic block diagram of an encoder for encoding an audio signal according to a first embodiment.

FIG. 1*a* shows an encoder 10 in the basic configuration. The encoder 10 comprises a predictor 12, here implemented as a linear predictor 12, as well as a factorizer 14, a transformer 16 and a quantize and encode stage 18.

The linear predictor 12 is arranged at the input in order to receive an audio signal AS, advantageously a digital audio signal such as a pulse code modulated signal (PCM). The linear predictor 12 is coupled to the factorizer 14 and to the output of the encoder, cf. reference numeral $DS_{LPC}/DS_{DV}$ via a so-called LPC-channel LPC. Furthermore, the linear predictor 12 is coupled to the transformer 16 via a so-called residual channel. Vice versa, the transformer 16 is (in addition to the residual channel) coupled to the factorizer 14 at its input side. At its output side the transformer is coupled to the quantize and encode stage 18, wherein the quantize and encode stage 18 is coupled to the output (cf. reference numeral $DS_{\hat{y}}$)). The two data streams $DS_{LPC}/DS_{DV}$ and $DS_{\hat{y}}$ form the data stream DS to be output.

Figure 1B:
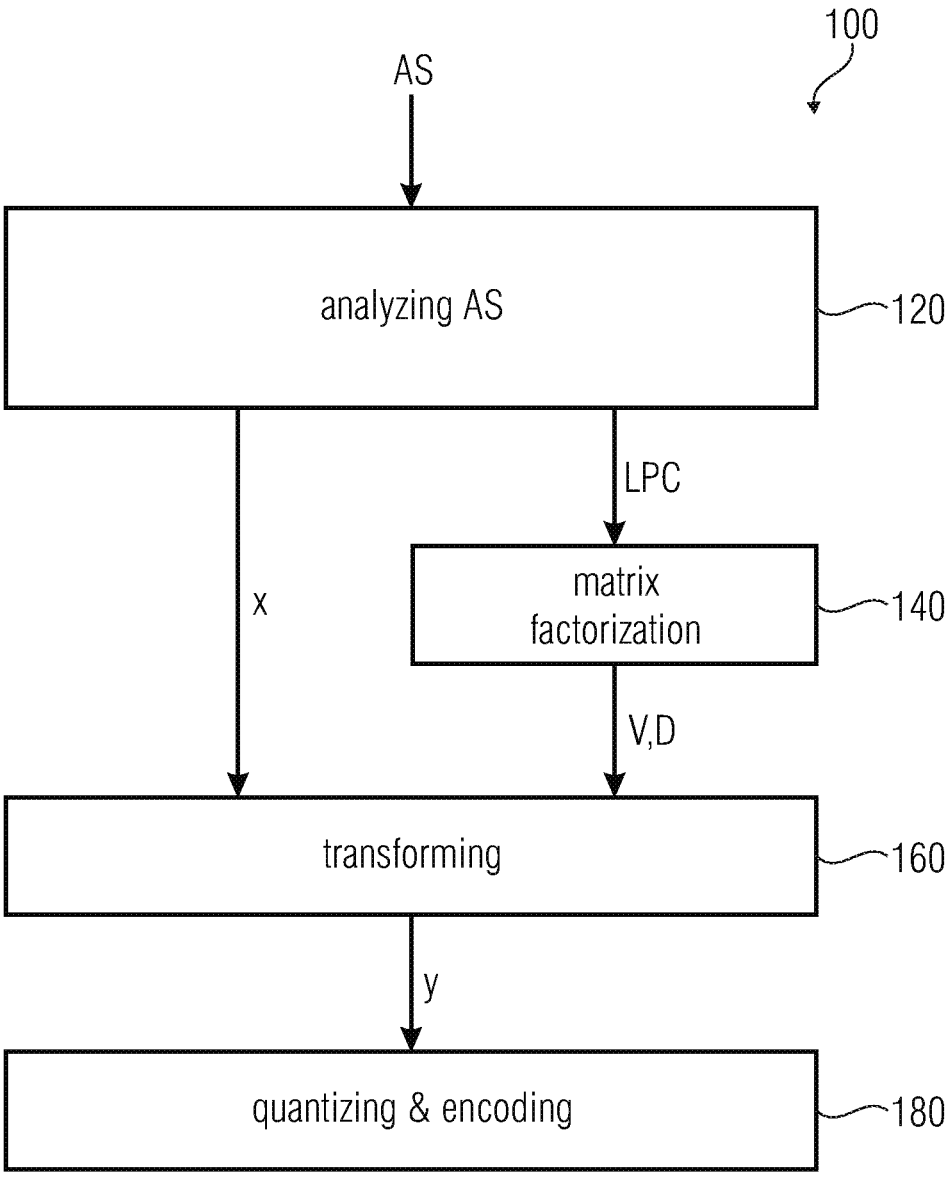
FIG. 1*b* shows a schematic flow chart of the corresponding method for encoding the audio signal according to the first embodiment.

The functionality of the encoder 10 will be discussed below, wherein additional references are made to FIG. 1*b* describing the method 100 for encoding. As can be seen according to FIG. 1*b*, the basic method 100 for encoding the audio signal AS into the data stream DS comprises the four basic steps 120, 140, 160 and 180 which are performed by the units 12, 14, 16 and 18. Within the first step 120, the linear predictor 12 analyses the audio signal AS in order to obtain linear prediction coefficients LPC. The linear prediction coefficients LPC describing a spectral envelope of the audio signal AS which enables to fundamentally synthesize of the audio signal using a so-called synthesis filter function H, afterwards. The synthesis filter function H may comprise weighted values of the synthesis filter function defined by the LPC coefficients. The linear prediction coefficients LPC are output to the factorizer 14 using the LPC-channel LPC as well as forwarded to the output of the encoder 10. The linear predictor 12 furthermore subjects the audio signal AS to an analysis filter function H which is defined by the linear prediction coefficients LPC. This process is the counterpart to the synthesis of the audio signal based on the LPC coefficients performed by a decoder. The result of this substep is a residual signal x output to the transformer 16 without the signal portion describable by the filter function H. Note that this step is performed frame-wise, i.e. that the audio signal AS having a amplitude and a time domain is divided or sampled into time windows (samples), e.g. having a length of 5 ms, and quantized in a frequency domain.

The subsequent step is to the transformation of the residual signal x (cf. method step 160) performed by the transformer 16. The transformer 16 is configured to transform the residual signal x in order to obtain a transformed residual signal y output to the quantize and encode stage 18. For example, the transformation 160 may be based on the formula $y=D^{1/2}Vx$ or the formula y=DVx, wherein the matrices D and V are provided by the factorizer 14. Thus, the transformation of the residual signal x is based on at least two factorized matrices V, exemplarily referred to as Vandermonde matrix and D exemplarily referred to as diagonal matrix.

The applied matrix factorization can be freely chosen as, for example, the eigen decomposition, Vandermonde factorization, Cholesky decomposition or similar. The Vandermonde factorization may be used as a factorization of symmetric, positive definite Toeplitz matrices, such as autocorrelation matrices, into product of Vandermonde matrices V and V. For the autocorrelation matrix in the objective function, this corresponds to a warped discrete Fourier transform, which is typically called the Vandermonde transform. This step 140 of matrix factorization performed by the factorizer 14 and representing a fundamental part of the invention, will be discussed in detail after discussing the functionality of the quantize and encode stage 18.

The quantize and encode stage 18 quantizes the transformed residual signal y, received from the transformer 16, in order to obtain a quantized transformed residual signal $\hat{y}$. This transformed quantized residual signal $\hat{y}$ is output as a part of the data stream $DS_{\hat{y}}$. Note, the entire data stream DS comprises the LPC-part, referred by the $DS_{LPC}/DS_{DV}$, and the $\hat{y}$ part referred by $DS_{\hat{y}}$.

The quantization of the transform residual signal y may, for example, by performed using an objective function, e.g., in terms of $$\eta(y) = \frac{(y * \hat{y})^2}{\|\hat{y}\|^2}.$$

This objective function has, when compared to a typical objective function of a ACELP encoder, a reduced complexity such that the encoding is advantageously improved regarding its performance. This performance improvement may be used for encoding audio signals AS having a higher resolution or for reducing the necessitated resources.

It should be noted that the signal $DS_{\hat{y}}$ may be an encoded signal, wherein the encoding is performed by the quantize and encode stage 18. Thus, according to further embodiments, the quantize and encode stage 18 may comprise an encoder which may be configured to arithmetic encoding. The encoder of the quantize and encode stage 18 may use linear quantization steps (i.e. equal distance) or variable, such as logarithmic, quantization steps. Alternatively, the encoder may be configured to perfume another (lossless) entropy encoding, wherein the code length varies as a function of the probability of the singular input signals AS. Thus, to obtain the optimum code length it may be an alternative option to detect the probability of the input signals based on the synthesis envelope and thus based on the LPC coefficients. Therefore, the quantized encoding stage may also have an input for the LPC channel.

Below, the background enabling the complexity reduction of the objective function η(y) will be discussed. As mentioned above, the improved encoding is based on the step of matrix factorization 140 performed by the factorizer 14. The factorizer 14 factorizes a matrix, e.g., an autocorrelation matrix R or a covariance matrix C of the filter synthesis function H defined by a linear prediction coefficients LPC (cf. LPC channel). The result of this factorization are two factorized matrices, for example, the Vandermonde matrix V and the diagonal matrix D representing the original matrix H comprising the singular LPC coefficients. Due to this the samples of the residual signal x are decorrelated. It follows that direct quantization (cf. step 180) of the transform residual signal is the optimum quantization, whereby a computational complexity is almost independent of the bit rate. In comparison, a conventional approach to optimizing of the ACELP codebook balances between computational complexity and accuracy, especially at high bit rates. The background is therefore really discussed starting from the conventional ACELP proceedings.

The conventional objective function of ACELP takes the form of a covariance matrix. According to improved approaches there is an alternative objective function which employs an autocorrelation matrix of the weighted synthesis function. Codecs based on ACELP optimized signal to noise ratio (SNR) in a perceptually weighted synthesis domain. The objective function can be expressed as $$\eta(x,y)=\|H(x-y\hat{x})\|^2 \tag{1}$$

where x is the target residual, $\hat{x}$ the quantized residual, H the convolution matrix corresponding to the weighted synthesis filter and γ a scale gain coefficient. To find the optimal quantization $\hat{x}$, the standard approach is to find the optimal value of γ, denoted by γ*, at the zero of the derivative of η(x,γ). By inserting the optimal γ* into the equation (1) the new objective function is obtained:

$$\eta(x) = \frac{(x^* H^* H\hat{x})^2}{\hat{x}^* H^* H\hat{x}} \tag{2}$$

wherein H* is the transformed-conjugated version of the synthesis with the function H.

Note that the conventional approach H is a square lower-triangular convolution matrix, whereby the covariance matrix C=H*H is a symmetric covariance matrix. The replacement of the lower-triangular matrix with the full size convolution matrix, whereby the autocorrelation matrix R=to H*H is a symmetric Toeplitz matrix, corresponds to the other correlation of the weighted synthesis filter. This replacement gives significant reductions and complexity, with minimum impact on quality.

The linear predictor 14 may use both, namely the covariance matrix C or the autocorrelation matrix R for the matrix factorization. The discussion below is made on the assumption that the autocorrelation R is used for modifying the objective function by factorization of a matrix dependent on the LPC coefficients. The symmetric positive defined Toeplitz matrices such as R can be decomposed as $$R=V^*DV \tag{3}$$

through several methods, including the eigenvalue decomposition. Here, V* is the transformed-conjugated version of the Vandermonde matrix V. In the conventional approach using the covariance matrix C other factorization can be applied such as a singular value decomposition C=USV.

For the autocorrelation matrix an alternative factorization, here referred to as Vandermonde factorization, which is also of the form of equation (3) may be used. The Vandermonde factorization is a new concept enabling factorization/transform. The Vandermonde matrix has a V with value of $|v_k|=1$ and $$V = \begin{pmatrix} 1 & v_0 & v_0^2 & \dots & v_0^{n-1} \\ 1 & v_1 & v_1^2 & \dots & v_1^{N-1} \\ \vdots & \vdots & & \vdots & \\ 1 & v_{N-1} & v_{N-1}^2 & \dots & v_{N-1}^{N-1} \end{pmatrix} \quad (4)$$

and D is diagonal matrix with strictly positive entries. The decomposition can be calculated with arbitrary precision with complexity O ($N^3$). Direct decomposition has typically computational complexity of O(N^3), but here it can be reduced to O(N^2) or if an approximate factorization is sufficient, then complexity can be reduced to O(N log N). For the chosen decomposition, it may be defined:

$$y=D^{1/2}Vx \text{ and } \hat{y}=D^{1/2}V\hat{x} \quad (5)$$

where $x=V^{-1}D^{-1/2}{}_y$ and insert into equation (2) it can be obtained:

$$\eta(y) = \frac{(y^*\hat{y})^2}{\|\hat{y}\|^2} \quad (6)$$

Note that here, samples of y are not correlated to each other, and the above objective function is nothing more than a normalized correlation between target and the quantized residual. It follows that the samples of y can be independently quantized and if the accuracy of all samples is equal, then this quantization yields the best possible accuracy.

In the case of Vandermonde factorization, since V has value of $|v_k|=1$ it corresponds to a warped discrete Fourier transform and the elements of y correspond to a frequency component of the residual. Furthermore, multiplication by the diagonal matrix D corresponds to a scaling of the frequency bands and it follows that y is a frequency domain representation of the residual.

In contrast, eigendecomposition has a physical interpretation only when the window length approaches infinity, when the eigendecomposition and Fourier transform coincide. The finite-length eigen decompositions are therefore loosely related to a frequency representation of the signal, but labeling the components to frequencies is difficult. Still, the eigendecomposition is known to be an optimal basis, whereby it can in some cases give the best performance.

Starting from these two factorized matrices V and D the transformer 16 performs the transformation 160 such that the residual signal x is transformed using the decorrelated vector defined by equation (5).

Assuming x is uncorrelated white noise, then the samples of Vx will also have equal energy expectation. As a result of this, an arithmetic encoder or an encoder using an algebraic codebook to encode the values may be used. However, quantization of Vx is not optimal with respect to the objective function since it omits the diagonal matrix $D^{1/2}$. On the other hand, the full transformation $y=D^{1/2}Vx$ includes scaling by the diagonal matrix D, which changes the energy expectation of the samples of y. To create an algebraic codebook with non-uniform variance is not trivial. Therefore, it may be an option to use an arithmetic codebook instead to obtain optimal bit consumption. Arithmetic coding can then be defined exactly as revealed in [14].

Note that, if the decomposition is used, such as the Vandermonde transformation or another complex transformation, the real and the imaginary parts are independent random variables. If the variants of the complex variable is $\sigma^2$, then the real and imaginary parts have a variance of $\sigma^2/2$. The real valued decompositions such as the eigenvalue decomposition provide only real values, whereby separation of real and imaginary parts is not necessary. For higher performance with complex valued transforms, conventional methods for arithmetic coding of complex values can be applied.

According to the above embodiment the prediction coefficients LPC (cf. $DS_{LPC}$) are output as LSF signals (line spectral frequency signals), wherein it is an alternative option to output the prediction coefficients LPC within factorized matrices V and D (cf. $DS_{DV}$). This alternative option is implied by the broken line marked by V,D and indication that $DS_{DV}$ results from the output of the factorizer 14.

Therefore another embodiment of the invention refers to a data stream (DS) comprising the prediction coefficients LPC in form of two factorized matrices ($DS_{VD}$).

With respect to FIG. 2*a* and FIG. 2*b* the decoder 20 and the corresponding method 200 for decoding will be discussed.

Figure 2A:
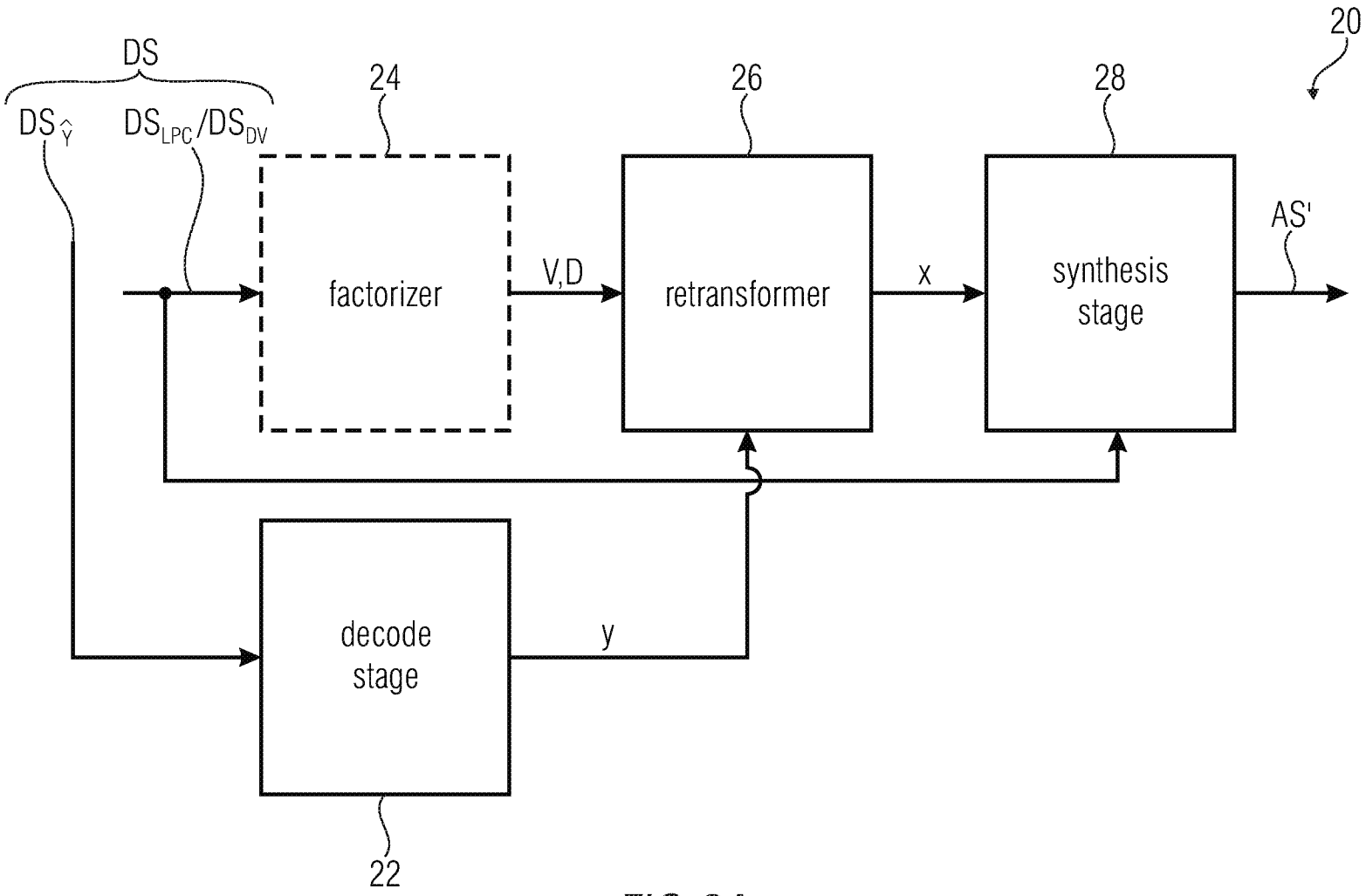
FIG. 2*a* shows a schematic block diagram of a decoder for decoding a data stream according to a second embodiment.
Figure 2B:
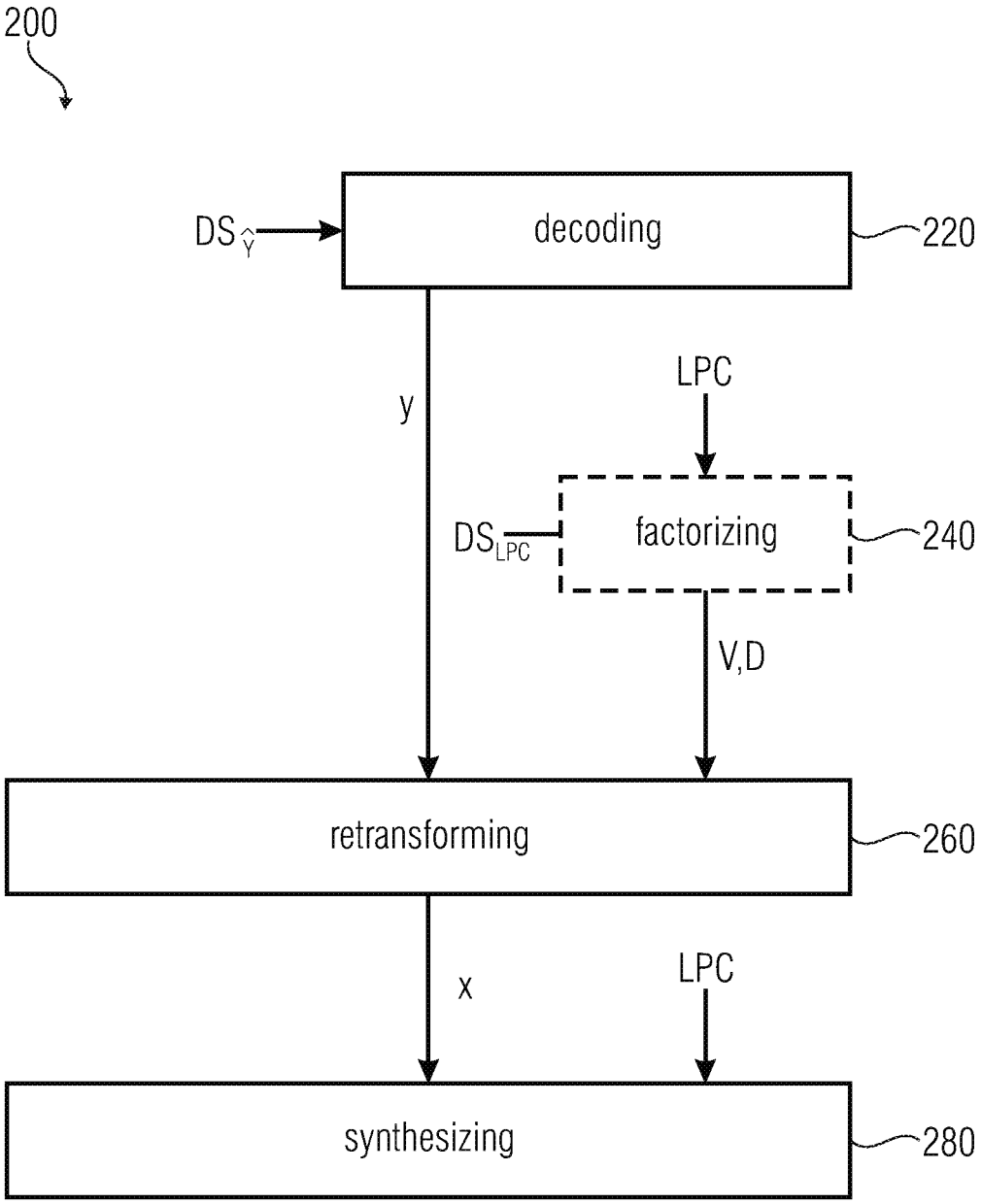
FIG. 2*b* shows a schematic flow chart of the corresponding method for decoding a data stream according to the second embodiment.

FIG. 2*a* shows the decoder 20 comprising a decode stage 22, an optional factorizer 24, a retransformer 26 and a synthesis stage 28. The decode stage 22 as well as the factorizer 24 are arranged at the input of the decoder 20 and thus configured to receive the data stream DS. In detail, a first part of the data stream DS, namely the linear prediction coefficients are provided to the optional factorizer 24 (cf. $DS_{LPC}/DS_{DV}$), wherein the second part, namely the quantized transform residual signal ŷ or the encoded quantized transform residual signal $\hat{y}$ are provided to the encode stage 22 (cf. $DS_{\hat{y}}$). The synthesis stage 28 is arranged at the output of the decoder 20 and configured to output an audio signal AS' similar, but not equal to the audio signal AS.

The synthetization of the audio signal AS' is based on the LPC coefficients (cf. $DS_{LPC}/DS_{DV}$) and based on the residual signal x. Thus, the synthesis stage 28 is coupled to the input to receive the $DS_{LPC}$ signal and to the retransformer 26 providing the residual signal x. The retransformer 26 calculates the residual signal x based on the transformed residual signal y and based on the at least two factorized matrices V and D. Thus, the retransformer 26 has at least two inputs, namely a first for receiving V and D, e.g. from the factorizer 24, and one for receiving transformed residual signal y from the decoder stage.

The functionality of the decoder 20 will be discussed in detail below taking reference to the corresponding method 200 illustrated by FIG. 2*b*. The decoder 20 receives the date stream DS (from an encoder). This data signal DS enables the decoder 20 to synthesize the audio signal AS', wherein the part of the data stream referred by $DS_{LPC}/DS_{DV}$ enables the synthesis of the fundamental signal, wherein the part referred by $DS_{\hat{y}}$, enables the synthesis of the detailed part of the audio signal AS'. Within a first step 220 the decoder stage 22 decodes the inbound signal $DS_{\hat{y}}$ and outputs the transformed residual signal y to the retransformer 26 (cf. step 260).

In parallel or in serial the factorizer 24 performs a factorization (cf. step 240). As discussed with respect to step 140 the factorizer 24 applies a matrix factorization onto the autocorrelation matrix R or the covariance matrix C of the synthesis filter function H, i.e., that the factorization used by the decoder 20 is similar or nearly similar to the factorization described in context of encoding (cf. method 100) and, thus, may be an eigenvalue decomposition or a Cholesky factorization as discussed above. Here, the synthesis filter function H is deviated from the inbound data stream $DS_{LPC}/DS_{DV}$.

Furthermore, the factorizer 24 outputs the two factorized matrices V and D to the retransformer 26.

Based on the two matrices V and D the retransformer 26 retransforms a residual signal x from the transformed residual signal y and outputs the x to the synthesis stage 28 (cf. step 280). The synthesis stage 28 synthesizes the audio signal AS' based on the residual signal x as well as based on the LPC coefficients LPC received as data stream $DS_{LPC}$/$DS_{DV}$. It should be noted that the audio signal AS' is similar but not equal to the audio signal AS since the quantization performed by the encoder 10 is not lossless.

According to another embodiment, the factorized matrices V and D may be provided to the retransformer 26 from another entity, for example directly from the encoder 10 (as a part of the data stream). Thus, the factorizer 24 of the decoder 20 as well as the step 240 of matrix factorization are optional entities/steps and therefore illustrated by the broken lines. Here, it may be an alternative option that the prediction coefficients LPC (based on which the synthesis 280 is performed) may be derived from inbound factorized matrices V and D. In other words that means that the data stream DS comprises $DS_{\hat{y}}$ and the matrices V and D (i.e. $DS_{DV}$) instead of $DS_{\hat{y}}$ and $DS_{LPC}$.

The performance improvements of the above described encoding (as well as the decoding) are discussed below with respect to FIGS. 3*a* and 3*b*.

Figure 3A:
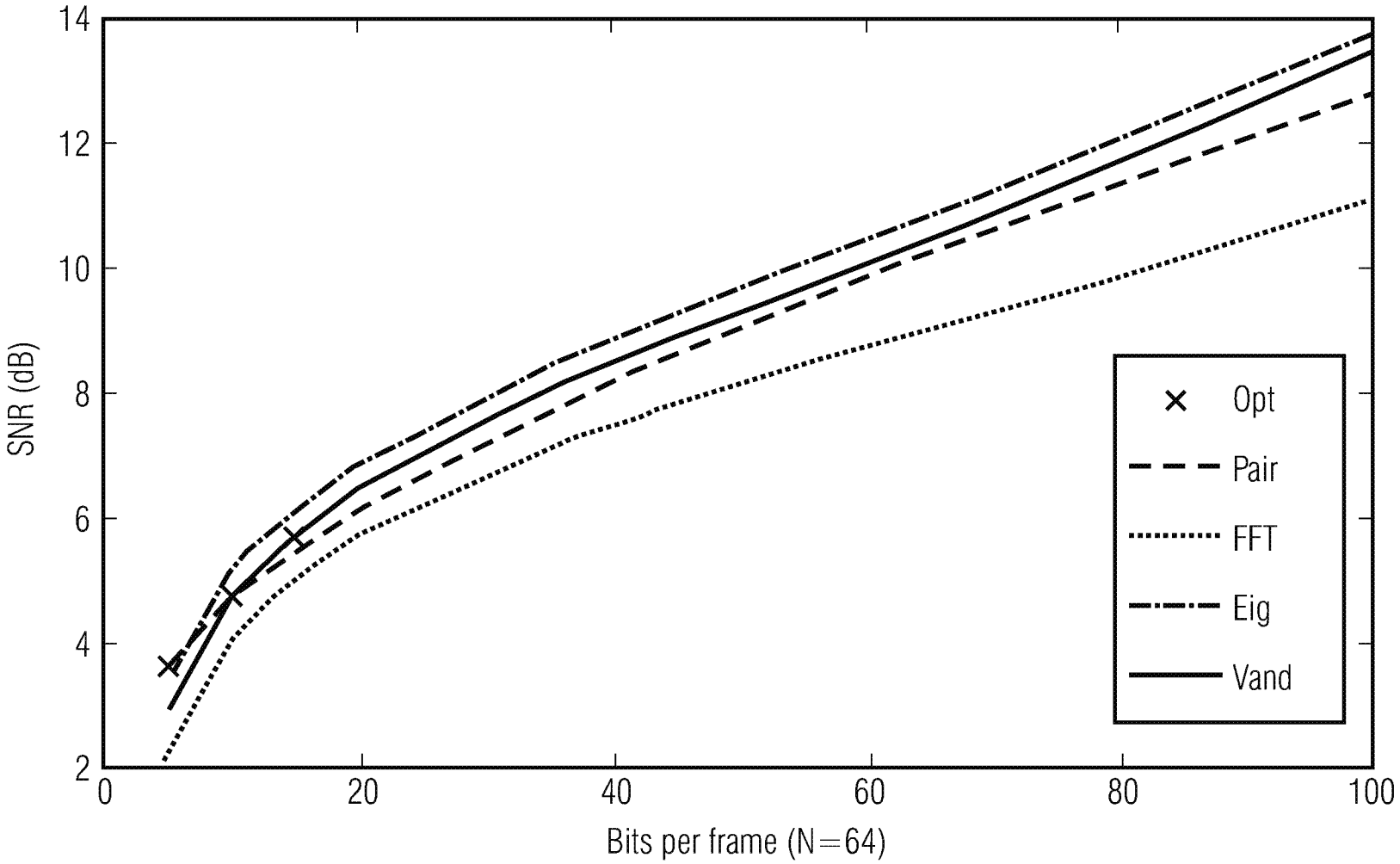
FIG. 3*a* shows a schematic diagram illustrating the mean perceptual signal to noise ratio as a function of the bits per frame for different quantization methods.

FIG. 3*a* shows a diagram illustrating the mean perceptual signal to noise ratio as a function of bits used for encoding the receivable of length and equal 64 frames. In the diagram 5 curves for five different approaches of quantization are illustrated, wherein two approaches, namely the optimal quantization and the pairwise iterative quantization are conventional approaches. Formula (1) forms the basis of the this comparison. As a comparison of the quantization performance of the proposed decorrelation method with the conventional time domain representation of the residual signal, the ACELP codec has been implemented as follows. The input signal was resampled to 12.8 kHz and a linear predictor was estimated with a Hamming window of length 32 ms, centered at each frame. The prediction residual was then calculated for frames of length 5 ms, corresponding to a subframe of the AMR-WB codec. A long time predictor was optimized at integer lags between 32 and 150 samples, with an exhaustive search. The optimal value was used for the LTP gain without quantization.

Pre-emphasis with the filter $(1-0.68z^{-1})$ was applied to the input signal and in synthesis as in AMR-WB. The perceptual weighting applied was $A(0.92z^{-1})$, where A(z) is a linear predictive filter.

To evaluate the performance it is necessitated to compare the proposed quantization with conventional approaches (optimal quantization and pairwise iterative quantization). The most often used approaches divides the residual signal of a frame of a length of 64 frames into 4 interlaced tracks. This approach was applied with two methods, namely the optimal quantization (cf. by Opt) approach where all combinations are tried in an exhaustive search or the pairwise iterative quantization (cf. Pair) where two pulses were consecutively added by trying them on every possible position.

The former becomes computationally unfeasibly complex for bit rates above 15 bits per frame, while the latter is sub-optimal. Note that also the latter is more complex than the state of the art methods applied in codecs such as AMR-WB but, therefore, it is also most likely yields a better signal to noise ratio. The conventional methods are compared with the above discussed algorithms for quantization.

The Vandermonde quantize (cf. Vand) transforms the residual vector x by $y=D^{1/2}Vx$ where matrices V and D are obtained from the Vandermonde factorization and quantization is using the arithmetic coder. The Eigenvalue quantize (cf. Eig) is similar to the Vandermonde quantize but where the matrices V and D are obtained by eigenvalue decompositions. Furthermore, also an FFT quantize (cf. FFT) may be applied. i.e., according to a further embodiment the combination of windowing using filters at the transformation of $y=D^{1/2}$ Vx can be used in place of the discrete Fourier transformation (DFT), discrete cosine transformation (DCT), the modified discrete cosine transformation (MDCT) or other transformations in signal processing algorithms. The FFT (fast Fourier transformation) of the residual signal is taken where the same arithmetic coder as for the Vandermonde quantize is applied. The FFT approach will obviously give a poor quality since it is well known that it is important to take the correlation between samples in equation (2) into account. This quantize is thus a lower reference point.

The demonstration of the performance of the described method is illustrated by FIG. 3*a* evaluating the mean long perceptual signal to noise ratio and the complexity of methods as defined by equation (1). It can clearly be seen that, as expected, quantization in the FFT-domain gives the worst signal to noise ratio. The poor performance can be attributed to the fact that this quantize does not take into account the correlation between residual samples. Furthermore, it can be stated that the optimal quantization of the time-domain residual signals is equal to the pair-wise optimization at 5 and 10 bits per frame, since at those bit rates there are only 1 or 2 pulses, whereby the methods are exactly the same. For 15 bits per frame the optimal method is slightly better than pair-wise optimization as expected.

At 10 bits per frame and above, a quantization in Vandermonde domain is better than the time-domain quantizes and Eigenvalue domain is one step better than the Vandermonde domain. At 5 bits per frame the performance of arithmetic coders rapidly decrease most likely because it is known to be suboptimal for very sparse signals.

Observe also that the pair-wise method starts to deviate from the pair-wise method above 80 bits per frame. Informal experiments show that this trend increases at higher bit rates such that eventually the FFT and the pair-wise methods reach similar signal to noise ratio, much lower than the eigenvalue and Vandermonde methods. In contrast, eigenvalue and Vandermonde value continue as more or less linear functions of bit rate. The eigenvalue method is consistently approximately 0.36 dB better than the Vandermonde method. The hypothesis is that at least part of this difference is explained by the separation of the real and complex parts in the arithmetic coder. For optimal performance, the real and complex parts should be jointly encoded.

Figure 3B:
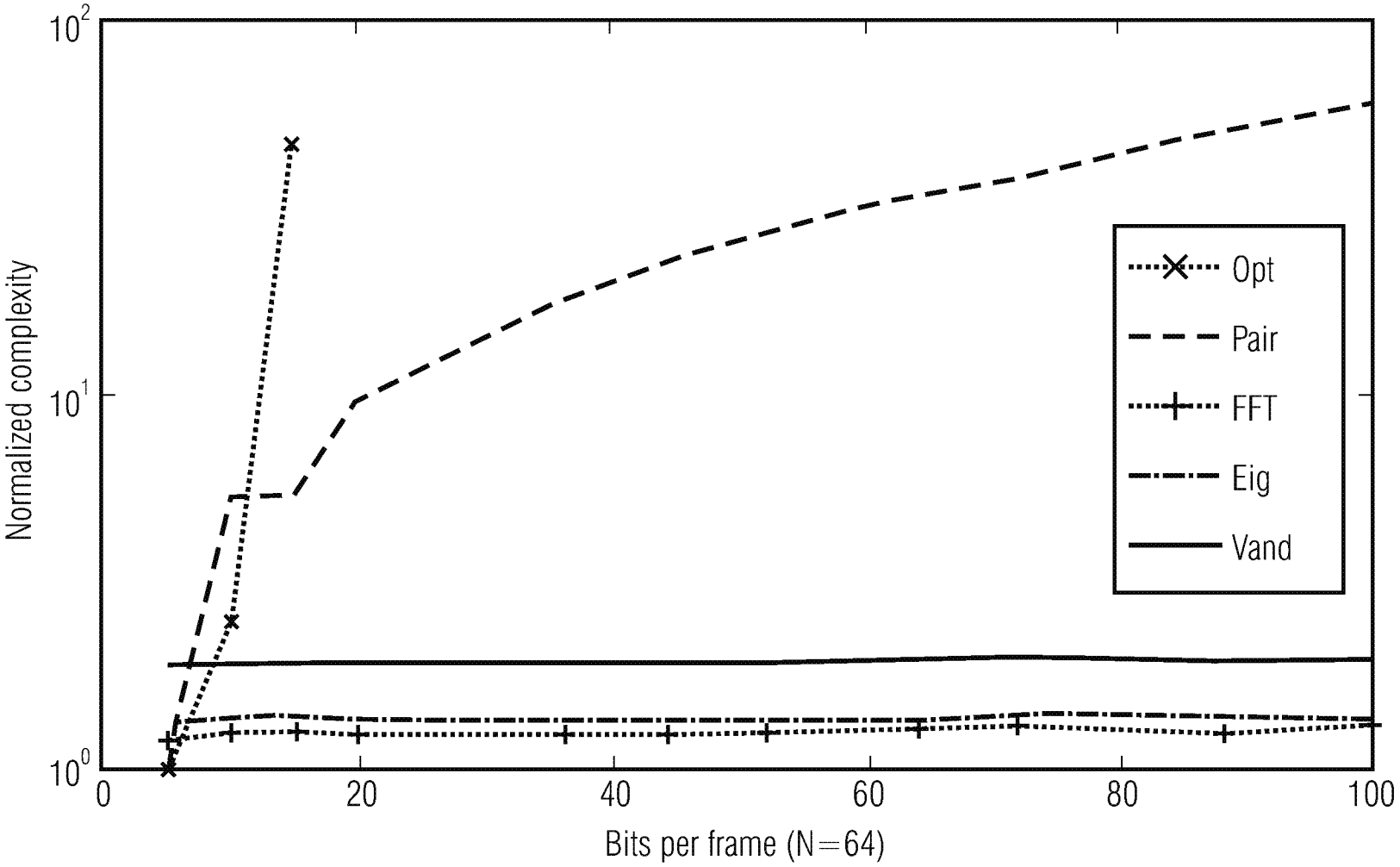
FIG. 3*b* shows a schematic diagram illustrating the normalized running time of the different quantization methods as a function of the bits per frame.

FIG. 3*b* shows a measurement of the running time of each approach at each bit rate for illustrating an estimate of the complexity of the different algorithms. It can be seen that the complexity of the optimal time-domain approach (cf. Opt) explodes already at low bit rates. The pair-wise optimization of the time-domain residual (cf. Pair), in turn, increases linearly as a function bitrate. Note that the state of the art methods limit the complexity of the pair-wise approach such that it becomes constant for high bit rates although the competitive signal to noise ratio results of the experiment illustrated by FIG. 3*a* cannot be reached with such limits. Further, both decorrelation approaches (cf. Eig and Vand) as well as the FFT approach (cf. FFT) are approximately constant overall bit rates. The Vandermonde transform has in the above implementation roughly a 50% higher complexity than the eigendecomposition method but the reason for this can be explained by the usage of the highly optimized version of the eigendecomposition provided by MATLAB, whereas the Vandermonde factorization is not an optimal implementation. Importantly, however, at a bit rate of 100 bits per frame, the pair-wise optimized ACELP is roughly 30 and 50 times as complex as a Vandermonde and the eigendecomposition based algorithm, respectively. Only the FFT is faster than the eigendecomposition method, but since the signal to noise ratio of FFT is poor, it is not a viable option.

To summarize, the above described method has two significant benefits. Firstly, by applying quantization in the perceptual domain, the perceptual signal to noise ratio is improved. Secondly, since the residual signal is decorrelated (with respect to the objective function) a quantization can be applied directly, without the highly complex analysis-by-synthesis loop. It follows that the computational complexity of the proposed method is almost constant with respect to bit rates, whereas the conventional approach becomes increasingly complex with increasing bit rate.

The above presented approach is fully inoperable with conventional speech and audio coding methods. Specifically, decorrelation of the objective function could be applied in the ACELP mode of codes such as MPEG USAC or AMR-WB+, without restriction to the other tools present in the codec. The ways in which the core bandwidth or the bandwidth extension methods are applied would stay the same, the ways in which long term prediction, formant enhancement, bass post filtering etc., in an ACELP do not need to be changed, and the ways which different coding modes such are implemented (such as ACELP and TCX) and switching between these modes would not be affected from the decorrelation of the objective function.

On the other hand, it is obvious that all tools (i.e. at least all ACELP implementations) which use the same objective function (cf. equation (1)) can be readily reformulated to take advantage of the decorrelation. Thus, according to a further embodiment, the decorrelation, for example, to the long time prediction contribution can be applied and, thus, the gain factors can be calculated using the decorrelated signal.

Moreover, since the presented transform domain is a frequency domain representation, classical methods of frequency domain speech and audio codecs may also be applied to this novel domain according to further embodiments. According to a special embodiment, in quantization of spectral lines, a dead-zone may be applied to increase efficiency. According to another embodiment noise filling may be applied to avoid spectral holes.

Although the above embodiment of encoding (cf. FIGS. 1*a* and 1*b*) has been discussed in context of an encoder using a linear predictor, it should be noted that the predictor may also be configured to contain a long time predictor to determine long time prediction coefficients describing the fundamental frequency of the audio signal AS and to filter the audio signal AS based on a filter function defined by the long time prediction coefficients and to output the residual signal x for the further processing. According to a further embodiment the predictor may be a combination of a linear predictor and lone time predictor.

It is clear that the proposed transform can be readily applied to other tasks in speech and audio processing such as speech enhancement. Firstly, the sub-space based methods are based on the eigenvalue decomposition or the singular value decomposition of the signal. Since the presented approach is based on similar decompositions, speech enhancement methods based on sub-space analysis may be adapted to the proposed domain according to a further embodiment. The difference to the conventional sub-space methods is when a signal model, based on linear prediction and windowing in the residual domain, is applied, such as is applied in ACELP. In contrast, traditional subspace methods apply overlapping windows which are fixed over time (non-adaptive).

Secondly, the decorrelation based on Vandermonde decorrelation provides a frequency domain similar to that provided by the discrete Fourier, cosine or other similar transforms. Any speech processing algorithm which usually performs in the Fourier, cosine or similar transform domain can thus be applied with minimum modifications also in the transform domains of the above described approach. Thus, the speech enhancement using spectral substraction in the transform domain may be applied. i.e., that means that according to further embodiments the proposed transformation can be used in speech or audio enhancement, for example, with the method of spectral substraction, subspace analysis or their derivatives and modifications. Here, the benefits are that this approach uses the same windowing as ACELP so that the speech enhancement algorithm can be tightly integrated into a speech codec. Furthermore, the window of ACELP has lower algorithmic delay than those used in conventional subspace analysis. Consequently, windowing is thus based on a signal model of higher performance.

Referring to equation (5) which is used for the transformer 14, i.e., within step 140, it should be noted that their creation may also be different, for example, in the shape of y=DVx.

According to a further embodiment the encoder 10 may comprise a packer at the output configured to packetize the two data streams $DS_{LPC}/DS_{DV}$ and $DS_{\tilde{y}}$ to a common packet DS. Vice versa, the decoder 20 may comprise a depacketizer configured to split the data stream DS into the two packs $DS_{LPC}/DS_{DV}$ and $DS_{\tilde{y}}$.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The above described teachings will be discussed below with different wording and some more details which may help to illuminate the background of the invention. The Vandermonde transform was recently presented as a time-frequency transform which, in difference to the discrete Fourier transform, also decorrelates the signal. Although the approximate or asymptotic decorrelation provided by Fourier is sufficient in many cases, its performance is inadequate in applications which employ short windows. The Vandermonde transform will therefore be useful in speech and audio processing applications, which have to use short analysis windows because the input signal varies rapidly over time. Such applications are often used on mobile devices with limited computational capacity, whereby efficient computations are of paramount importance.

Implementation of the Vandermonde transform has, however, turned out to be a considerable effort: it necessitates advanced numerical tools whose performance is optimized for complexity and accuracy. This contribution provides a baseline solution to this task including a performance evaluation. Index Terms—time-frequency transforms, decorrelation, Vandermonde matrix, Toeplitz matrix, warped discrete Fourier transform The discrete Fourier transform is one of the most fundamental tools in digital signal processing. It provides a physically motivated representation of an input signal in the form of frequency components. Since the Fast Fourier Transform (FFT) calculates the discrete Fourier transform also with very low computational complexity O(N log N), it has become one of the most important tools of digital signal processing.

Although celebrated, the discrete Fourier transform has a blemish: It does not decorrelate signal components completely (for a numerical example, see Section 4). Only when the transform length converges to infinity do the components become orthogonal. Such approximate decorrelation is in many applications good enough. However, applications which employ relatively small transforms such as many speech and audio processing algorithms, the accuracy of this approximation limits the overall efficiency of algorithms. For example, the speech coding standard AMR-WB employs windows of length N=64. Practice has shown that performance of the discrete Fourier transform is in this case insufficient and consequently, most mainstream speech codecs use time-domain encoding.

Figure 3C:
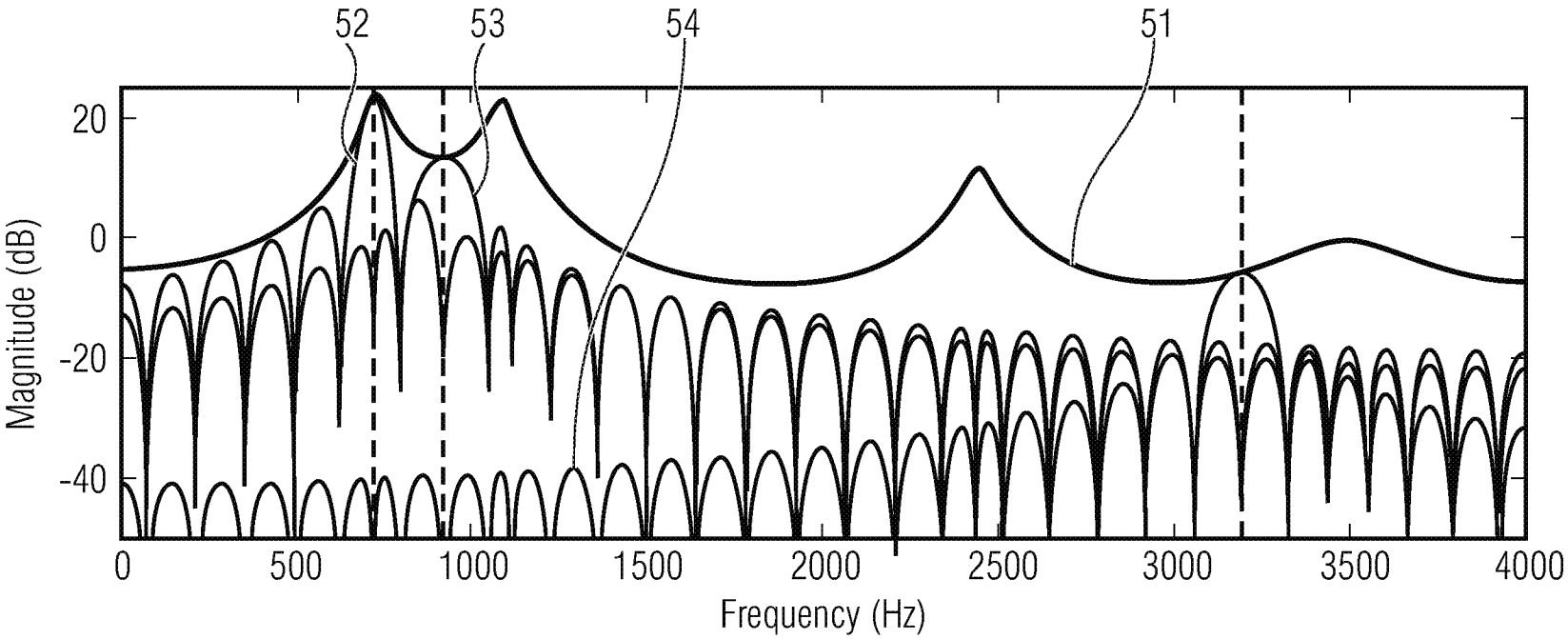
FIG. 3*c* shows a schematic diagram illustrating characteristics of a Vandermonde transform.

FIG. 3*c* shows Characteristics of a Vandermonde transform; the thick line marked by 51 illustrates the (non-warped) Fourier spectrum of a signal and the lines 52, 53 and 54 are the response of pass-band filters of three selected frequencies, filtered with the input signal. The Vandermonde factorization size is 64.

There are naturally plenty of transforms which provide decorrelation of the input signal, such as the Karhunen-Loève transform (KLT). However, the components of the KLT are abstract entities without a physical interpretation as simple as the Fourier transform. A physically motivated domain, on the other hand, allows straightforward implementation of physically motivated criteria into the processing methods. A transform which provides both a physical interpretation and decorrelation is therefore desired.

We have recently presented a transform, called the Vandermonde transform, which has both of the advantageous characteristics. It is based on a decomposition of a Hermitian Toeplitz matrix into a product of a diagonal matrix and a Vandermonde matrix. This factorization is actually also known as the Caratheodory parametrization of covariance matrices and is very similar to the Vandermonde factorization of Hankel matrices.

For the special case of positive definite Hermitian Toeplitz matrices, the Vandermonde factorization will correspond to a frequency-warped discrete Fourier transform. In other words, it is a time-frequency transform which provides signal components sampled at frequencies which are not necessarily uniformly distributed. The Vandermonde transform thus provides both the desired properties: decorrelation and a physical interpretation.

While the existence and properties of the Vandermonde transform have been analytically demonstrated, the purpose of the current work is, firstly, to collect and document existing practical algorithms for Vandermonde transforms. These methods have appeared in very different fields, including numerical algebra, numerical analysis, systems identification, time-frequency analysis and signal processing, whereby they are often hard to find. This paper is thus a review of methods which provide a joint platform for analysis and discussion of results. Secondly, we provide numerical examples as a baseline for further evaluation of the performance of the different methods.

This section provides a brief introduction to Vandermonde transforms. For a more comprehensive motivation and discussion about applications, we refer to.

A Vandermonde matrix V is defined by the scalars vk as $$V = \begin{bmatrix} 1 & v_0 & v_0^2 & \dots & v_0^{N-1} \\ 1 & v_1 & v_1^2 & \dots & v_1^{N-1} \\ \vdots & \vdots & & & \vdots \\ 1 & v_{N-1} & v_{N-1}^2 & \dots & v_{N-1}^{N-1} \end{bmatrix} \tag{1z}$$

It is full rank if scalars $v_k$ are distinct ($v_k \neq v_h$ for $k \neq h$) and its inverse has an explicit formula.

A symmetric Toeplitz matrix T is defined by scalars $\tau_k$ as $$T - \begin{bmatrix} \tau_0 & \tau_1 & \dots & \tau_{N-1} \\ \tau_1 & \tau_0 & \ddots & \vdots \\ \vdots & \ddots & \ddots & \tau_1 \\ \tau_{N-1} & \dots & \tau_1 & \tau_0 \end{bmatrix} \tag{2z}$$

If T is positive definite, then it can be factorized as $$T = V^* \Lambda V, \tag{3z}$$

where $\Lambda$ is a diagonal matrix with real and strictly positive entries $\Lambda_{kk} > 0$ and the exponential series V are all on the unit circle $v_k = \exp(i\beta_k)$. This form is also known as the Carathéodory parametrization of a Toeplitz matrix.

We present here two uses for the Vandermonde transform: either as a decorrelating transform or as a replacement for a convolution matrix. Consider first a signal x which has the autocorrelation matrix $E[xx^*] = R$. Since the autocorrelation matrix is positive definite, symmetric and Toeplitz, we can factorize it as $R = V^* \Lambda V$. It follows that if we apply the transform $$y_d = V^{-*} x \tag{4z}$$

where $V^{-*}$ is the inverse Hermitian of V, then the autocorrelation matrix of $y_d$ is $$\begin{aligned} R_y = E[y_d y_d] = V^{-*} E[xx^*] V^{-1} = V^{-*} R_x V^{-1} = \\ V^{-*} V^* \Lambda V V^{-1} = \Lambda \end{aligned} \tag{5z}$$

The transformed signal $y_d$ is thus uncorrelated. The inverse transform is $$x = V^* y_d. \tag{6z}$$

As a heuristic description, we can say that the forward trans-form $V^{-*}$ contains in its kth row a filter whose pass-band is at frequency $-\beta_k$ and the stop-band output for x has low energy. Specifically, the spectral shape of the output is close to that of an AR-filter with a single pole on the unit circle. Note that since this filterbank is signal adaptive, we consider here the output of the filter rather than the frequency response of the basis functions.

The backward transform $V^*$ in turn has exponential series in its columns, such that x is a weighted sum of the exponential series. In other words, the transform is a warped time-frequency transform. FIG. 3*c* demonstrates the discrete (non-warped) Fourier spectrum of an input signal x and frequency responses of selected rows of $V^{-*}$.

The Vandermonde transform for evaluation of a signal in a convoluted domain can be constructed as follows. Let C be a convolution matrix and x the input signal. Consider the case where our objective is to evaluate the convoluted signal $y_c = C_x$. Such evaluation appears, for example, in speech codecs employing ACELP, where quantization error energy is evaluated in a perceptual domain and where the mapping to the perceptual domain is described by a filter.

The energy of $y_c$ is $$\|y_c\|^2 = \|Cx\|^2 = x^* C^* C x = x^* R_c x = x^* V^* \Lambda V x = \|\Lambda^{1/2} V x\|^2 \tag{7z}$$

The energy of $y_c$ is thus equal to the energy of the transformed and scaled signal $$y_v = \Lambda^{1/2} V x \tag{8z}$$

We can thus equivalently evaluate signal energy in the convolved or the transformed domain. $\|y_c\|^2 = \|y_v\|^2$. The inverse transform is obviously $$x = V^{-1} \Lambda^{-1/2} y_v. \tag{9z}$$

The forward transform V has exponential series in its rows, whereby it is a warped Fourier transform. Its inverse $V^{-1}$ has filters in its columns, with pass-bands at $\beta_k$. In this form the frequency response of the filter-bank is equal to a discrete Fourier transform. It is only the inverse transform which employs what is usually seen as aliasing components in order to enable perfect reconstruction.

For using Vandermonde transforms, we need effective algorithms for determining as well as applying the transforms. In this section we will discuss available algorithms. Let us begin with application of transforms since it is the more straightforward task.

Multiplications with V and $V^*$ are straightforward and can be implemented in $O(N^2)$. To reduce the storage requirements, we show here algorithms where exponents $v_k^h$ need not be explicitly evaluated for $h > 1$. Namely, if $y = Vx$ and the elements of x are $\xi_k$, then the elements $\eta_k$ of y can be determined with the recurrence $$\begin{cases} \tau_{h,0} = \xi_{N-1} \\ \tau_{h,k} = \xi_{N-1-k} + v_h \tau_{h,k-1}, \text{ for } 1 \le k \le N \\ \eta_h = \tau_{h,N-1}. \end{cases} \tag{10z}$$

Here $\tau_{h,k}$ is a temporary scalar, of which only the current value needs to be stored. The overall recurrence has N steps for N components, whereby overall complexity is $O(N^2)$ and storage constant. A similar algorithm can be readily written for $y = V^* x$.

Multiplication with the inverse Vandermonde matrices $V^{-1}$ and $V^{-*}$ is a slightly more complex task but fortunately relatively efficient methods are already available from literature. The algorithms are simple to implement and for both $x = V^{-1} y$ and $x = V^{-*} y$ the complexity is $O(N^2)$ and storage linear $O(N)$. However, the algorithm includes a division at every step, which has in many architectures a high constant cost.

Although the above algorithms for multiplication by the inverses are exact in an analytic sense, practical implementations are numerically unstable for large N. In our experience, computations with matrices up to a size of N~64 is sometimes possible, but beyond that the numerical instability renders these algorithms useless as such. A practical solution is Leja-ordering of the roots $v_k$ which is equivalent to Gaussian Elimination with Partial Pivoting. The main idea behind Leja-ordering is to reorder the roots in such a way that the distance of a root $v_k$ to its predecessors 0 . . . (k−1) is maximized. By such reordering the denominators appearing in the algorithm are maximized and values of intermediate variables are minimized, whereby the contributions of truncation errors are also minimized. Implementation of Leja-ordering is simple and can be achieved with complexity $O(N^2)$ and storage O(N).

The final hurdle is then obtaining the factorization, that is, the roots $v_k$ and when needed, the diagonal values $\lambda_{kk}$. From we know that the roots can be obtained by solving $$Ra=[1\ 1\ \ldots\ 1]^T, \tag{11z}$$

where a has elements $\alpha_k$. Then $v_0=1$ and the remaining roots $v_1 \ldots v_N$ are the roots of polynomial $A(z)=\Sigma_{K=0}^{N-1}\alpha_k z^{-k}$. We can readily show that this is equivalent with solving the Hankel system $$\begin{bmatrix} \tau_{N-1} & \ldots & \tau_1 & \tau_0 \\ \vdots & \iddots & \tau_0 & \tau_1 \\ \tau_1 & \iddots & \iddots & \vdots \\ \tau_0 & \tau_1 & \ldots & \tau_{N-1} \end{bmatrix} \begin{bmatrix} \hat{\alpha}_1 \\ \hat{\alpha}_2 \\ \vdots \\ \hat{\alpha}_N \end{bmatrix} = -\begin{bmatrix} \tau_1 \\ \tau_2 \\ \vdots \\ \tau_N \end{bmatrix} \tag{12z}$$

where $$\tau_N = \frac{1}{\alpha_0}\Sigma_{K=1}^{N-1}\alpha_{k+1}\tau_{N-k}.$$

The roots $v_k$ are then the roots of $\hat{A}(z)=1+\Sigma_{K=1}^{N}\hat{a}_k z^{-k}$. Since factorization of the original Toeplitz system Eq. 11z is equivalent with Eq. 12z, we can use a fast algorithm for factorization of Hankel matrices. This algorithm returns a tridiagonal matrix whose eigenvalues correspond to the roots of $\hat{A}(z)$. The eigenvalues can then be obtained in $O(N^2)$ by applying the LR algorithm, or in $O(N^3)$ by the standard non-symmetric OR-algorithm. The roots obtained this way are approximations, whereby they might be slightly off the unit circle. It is then useful to normalize the absolute value of the roots to unity, and refine with 2 or 3 iterations of Newton's method. The complete process has a computational cost of $O(N^2)$.

The last step in factorization is to obtain the diagonal values Λ. Observe that $$Re=V^*\Lambda Ve=V^*\lambda \tag{13z}$$

where $e=[1\ 0\ .\ .\ .\ 0]^T$ and λ is a vector containing the diagonal values of Λ. In other words, by calculating $$\lambda=V^{-*}(Re), \tag{14z}$$

we obtain the diagonal values $\lambda_{kk}$. This inverse can be calculated with the methods discussed above, whereby the diagonal values are obtained with complexity $O(N^2)$.

In summary, the steps necessitated for factorization of a matrix R are

1. Solve Eq. 11z for a using Levinson-Durbin or other classical methods.
2. Extend autocorrelation sequence by $$\tau_N = \frac{1}{\alpha_0}\Sigma_{K=1}^{N-1}\alpha_{k+1}\tau_{N-k}.$$

3. Apply tridiagonalization algorithm of on sequence $\tau_k$.
4. Solve eigenvalues vk using either the LR- or the symmetric OR-algorithm.
5. Refine root locations by scaling $v_k$ to unity and a few iterations of Newton's method.
6. Determine diagonal values $\lambda_{kk}$ using Eq. 14z.

Let us begin with a numerical example that demonstrates the concepts used. Here matrix C is a convolution matrix corresponding to the trivial filter $1+z^1$, matrix R its autocorrelation, matrix V the corresponding Vandermonde matrix obtained with the algorithm in Section 3, matrix F is the discrete Fourier transform matrix and the matrices $\Lambda_V$ and $\Lambda_F$ demonstrate the diagonalization accuracy of the two transforms. We can thus define $$C = \begin{bmatrix} 1 & 1 & 0 & 0 \\ 0 & 1 & 1 & 0 \\ 0 & 0 & 1 & 1 \end{bmatrix}, R = CC^* = \begin{bmatrix} 2 & 1 & 0 \\ 1 & 2 & 1 \\ 0 & 1 & 2 \end{bmatrix} \tag{15z}$$

$$V = \begin{bmatrix} 1 & 1 & 1 \\ 1 & i & -1 \\ 1 & -1 & -1 \end{bmatrix}, F = \begin{bmatrix} 1 & 1 & 1 \\ 1 & e^{-\frac{i\pi 2}{3}} & e^{+\frac{i\pi 2}{3}} \\ 1 & e^{+\frac{i\pi 2}{3}} & e^{-\frac{i\pi 2}{3}} \end{bmatrix}$$

whereby we can evaluate the diagonalization with $$\Lambda_V = |V^{-*}RV^{-1}| = \begin{bmatrix} 1 & 0 & 0 \\ 0 & 0.5 & 0 \\ 0 & 0 & 0.5 \end{bmatrix} \tag{16z}$$

$$\Lambda_F = |F^{-*}RF^{-1}| = \begin{bmatrix} 1.11 & 0.111 & 0.111 \\ 0.111 & 0.444 & 0.222 \\ 0.111 & 0.222 & 0.444 \end{bmatrix}$$

We can here see that with the Vandermonde transform we obtain a perfectly diagonal matrix $\lambda_V$. The performance of the discrete Fourier transform is far from optimal, since the off-diagonal values are clearly non-zero. As a measure of performance, we can calculate the ratio of the absolute sums of off- and on-diagonal values, which is zero for the Vandermonde factorization and 0.444 for the Fourier transform.

We can then proceed to evaluate the implementations described in Section 3. We have implemented each algorithm in MATLAB with the purpose of providing a performance baseline upon which future works can compare and to find eventual performance bottlenecks. We will consider performance in terms of complexity and accuracy.

To determine the performance of the factorization, we will compare the Vandermonde factorization to the discrete Fourier and Karhunen-Loève transforms, the latter applied with the eigenvalue decomposition. We have applied the Vandermonde factorization using two methods, firstly, the algorithm described in this article ($V_1$), and secondly, the approach described in using the built-in root-finding function provided by MATLAB ($V_2$). Since this MATLAB function is a finely tuned generic algorithm, we would expect to obtain accurate results but with higher complexity than our purpose-built algorithm.

As data for all our experiments we used the set of speech, audio and mixed sound samples used in evaluation of the MPEG USAC standard with a sampling rate of 12.8 kHz. The audio samples were windowed with Hamming windows to the desired length and their autocorrelations were calculated. To make sure the autocorrelation matrices are positive definite, the main diagonal was multiplied with $(1+10^{-5})$.

For performance measures we used computational complexity in terms of normalized running time and accuracy in terms of how close $\hat{A}=V^{-*}RV^{-1}$ is to a diagonal matrix, measured by the ratio of absolute sums of off- and on-diagonal elements. Results are listed in Tables 1 and 2.

TABLE 1

Complexity of factorization algorithms for different window lengths N in terms of normalized running time.

| N | 16 | 32 | 64 | 128 | 256 | 512 |
|---|---|---|---|---|---|---|
| $V_1$ | 1.00 | 3.02 | 10.13 | 35.96 | 131.80 | 496.91 |
| $V_2$ | 1.00 | 2.10 | 8.77 | 90.61 | 634.17 | 4056.62 |
| KLT | 1.00 | 4.33 | 8.93 | 30.59 | 109.53 | 419.76 |

TABLE 2

Accuracy of factorization algorithms for different window lengths N in terms of $\log_{10}$ of ratio of absolute sums of off- and on-diagonal values of $\hat{\Lambda} = V^{-*}R^{-1}$

| N | 16 | 32 | 64 | 128 | 256 | 512 |
|---|---|---|---|---|---|---|
| FFT | −0.22 | −0.16 | −0.13 | −0.11 | −0.08 | −0.07 |
| $V_1$ | −2.36 | −2.14 | −1.93 | −1.72 | −1.26 | −0.97 |
| $V_2$ | −13.00 | −13.56 | −13.11 | −12.67 | −12.14 | −11.56 |
| KLT | −14.56 | −14.24 | −14.07 | −13.89 | −13.65 | −13.23 |

Note that here it is not sensible to compare the running times between algorithms, only the increase in complexity as a function of frame size, because the built-in MATLAB functions have been implemented in a different language than our own algorithms. We can see that the complexity of the proposed algorithm $V_1$ increases with a comparable rate as the KLT, while the algorithm employing root-finding functions of MATLAB $V_2$ increases more. The accuracy of the proposed factorization algorithm $V_1$ is not yet optimal. However, since the root-finding function of MATLAB $V_2$ yields comparable accuracy as the KLT, we conclude that improvements are possible by algorithmic improvements.

The second experiment is application of transforms to determine accuracy and complexity. Firstly, we apply Eqs. 4z and 9z, whose complexities are listed in Table 3. Here we can see that matrix multiplication of KLT and the built-in solution of matrix systems of MATLAB $V_2$ have roughly the same rate of increase in complexity, while the proposed methods for Eqs. 4z and 9z have a much smaller increase. The FFT is naturally faster than all the other approaches.

Finally, to obtain the accuracy of Vandermonde solutions, we apply the forward and backward transforms in sequence. The Euclidean distances between original and reconstructed vectors are listed in Table 4. We can observe, firstly, that the FFT and KLT algorithms are, as expected, the most accurate, since they are based on orthonormal transforms. Secondly we can see that the accuracy of the proposed algorithm $V_1$ is slightly lower than the built-in solution of MATLAB $V_2$, but both algorithms provide sufficient accuracy.

We have presented implementation details of decorrelating time-frequency transforms using Vandermonde factorization with the purpose of reviewing available algorithms as well as providing performance baselines for further development. While the algorithms were in principle available from previous works, it turns out that getting a system to run requires an enhanced approach.

TABLE 3

Complexity of Vandermonde solutions for different window lengths N in terms of normalized running time. Here $V_1^{-*}$ and $V_1^{-1}$ signifies solution of Eqs. 4z and 9z with respective proposed algorithms

| N | 16 | 32 | 64 | 128 | 256 | 512 |
|---|---|---|---|---|---|---|
| FFT | 1.00 | 1.13 | 1.31 | 1.99 | 2.96 | 3.82 |
| $V_1^{-*}$ | 1.00 | 2.00 | 4.30 | 10.17 | 24.52 | 68.56 |
| $V_1^{-1}$ | 1.00 | 1.99 | 4.26 | 10.14 | 24.64 | 69.49 |
| $V_2$ | 1.00 | 1.86 | 7.57 | 23.16 | 78.44 | 284.80 |
| KLT | 1.00 | 1.31 | 5.37 | 8.55 | 46.25 | 289.30 |

TABLE 4

Accuracy of forward and backward transforms as measured by $\log_{10}(\|x-\hat{x}\|^2/\|x\|^2)$, where x and $\hat{x}$ are the original and reconstructed vectors.

| N | 16 | 32 | 64 | 128 | 256 | 512 |
|---|---|---|---|---|---|---|
| FFT | −15.82 | −15.71 | −15.66 | −15.62 | −15.58 | −15.55 |
| $V_1^{-*}$ | −14.62 | −14.07 | −13.43 | −12.89 | −12.40 | −12.11 |
| $V_1^{-1}$ | −15.15 | −14.84 | −14.51 | −14.14 | −13.78 | −13.42 |
| $V_2$ | −15.38 | −15.22 | −15.00 | −14.80 | −14.67 | −14.52 |
| KLT | −14.98 | −14.85 | −14.78 | −14.70 | −14.61 | −14.51 |

considerable effort. The main challenges are numerical accuracy and computational complexity. The experiments confirm that methods are available with $O(N^2)$ complexity, although obtaining low complexity simultaneously with numerical stability is a challenge. However, since the generic MATLAB implementations provide accurate solutions, we assert that obtaining high accuracy is possible with further tuning of the implementation.

In conclusion, our experiments show that for Vandermonde solutions, the proposed algorithms have good accuracy and sufficiently low complexity. For factorization, the purpose-built factorization does give better decorrelation than FFT with reasonable complexity, but in accuracy there is room for improvement. The built-in implementations of MATLAB give a satisfactory accuracy, which leads us to the conclusion that accurate $O(N^2)$ algorithms can be implemented.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] B. Bessette, R. Salami, R. Lefebvre, M. Jelinek, J. Rotola-Pukkila, J. Vainio, H. Mikkola, and K. Järvinen, "The adaptive multirate wideband speech codec (AMR-WB)," Speech and Audio Processing, IEEE Transactions on, vol. 10, no. 8, pp. 620-636, 2002.

[2] ITU-T G.718, "Frame error robust narrow-band and wideband embedded variable bit-rate coding of speech and audio from 8-32 kbit/s," 2008.

[3] M. Neuendorf, P. Gournay, M. Multrus, J. Lecomte, B. Bessette, R. Geiger, S. Bayer, G. Fuchs, J. Hilpert, N. Rettelbach, R. Salami, G. Schuller, R. Lefebvre, and B.

Grill, "Unied speech and audio coding scheme for high quality at low bitrates," in Acoustics, Speech and Signal Processing. ICASSP 2009. IEEE Int Conf, 2009, pp. 1-4.

[4] J.-P. Adoul, P. Mabilleau, M. Delprat, and S. Morissette, "Fast CELP coding based on algebraic codes," in Acoustics, Speech, and Signal Processing, IEEE International Conference on ICASSP'87, vol. 12. IEEE, 1987, pp. 1957-1960.

[5] C. Laamme, J. Adoul, H. Su, and S. Morissette, "On reducing computational complexity of codebook search in CELP coder through the use of algebraic codes," in Acoustics, Speech, and Signal Processing, 1990. ICASSP-90, 1990 International Conference on. IEEE, 1990, pp. 177-180.

[6] F.-K. Chen and J.-F. Yang, "Maximum-take-precedence ACELP: a low complexity search method," in Acoustics, Speech, and Signal Processing, 2001. Proceedings. (ICASSP'01). 2001 IEEE International Conference on, vol. 2. IEEE, 2001, pp. 693-696.

[7] K. J. Byun, H. B. Jung, M. Hahn, and K. S. Kim, "A fast ACELP codebook search method," in Signal Processing, 2002 6th International Conference on, vol. 1. IEEE, 2002, pp. 422-425. [8] N. K. Ha, \A fast search method of algebraic codebook by reordering search sequence," in Acoustics, Speech, and Signal Processing, 1999. Proceedings, 1999 IEEE International Conference on, vol. 1. IEEE, 1999, pp. 21-24.

[9] M. A. Ramirez and M. Gerken, "Efficient algebraic multipulse search," in Telecommunications Symposium, 1998. ITS'98 Proceedings. SBT/IEEE International. IEEE, 1998, pp. 231-236.

[10] T. Backstrom, "Computationally efficient objective function for algebraic codebook optimization in ACELP," in Interspeech 2013, August 2013.

[11] ı"Vandermonde factorization of Toeplitz matrices and applications in filtering and warping," IEEE Trans. Signal Process, vol. 61, no. 24, pp. 6257-6263, 2013.

[12] G. H. Golub and C. F. van Loan, Matrix Computations, 3rd ed. John Hopkins University Press, 1996.

[13] T. Bäckström, J. Fischer, and D. Boley, "Implementation and evaluation of the Vandermonde transform," in submitted to EUSIPCO 2014 (22$^{nd}$ European Signal Processing Conference 2014) (EUSIPCO 2014), Lisbon, Portugal, September 2014.

[14] T. Bäckström, G. Fuchs, M. Multrus, and M. Dietz, "Linear prediction based audio coding using improved probability distribution estimation," US Provisional Patent US 61/665,485, 6, 2013.

[15] K. Hermus, P. Wambacq et al., \A review of signal subspace speech enhancement and its application to noise robust speech recognition," EURASIP Journal on Applied Signal Processing, vol. 2007, no. 1, pp. 195-195, 2007.

The invention claimed is:

1. An audio encoder for encoding an audio signal into an audio data stream, comprising:

a predictor configured to analyze the audio signal in order to acquire prediction coefficients describing a spectral envelope of the audio signal or a fundamental frequency of the audio signal and to subject the audio signal to an analysis filter function dependent on the prediction coefficients in order to output a residual signal of the audio signal;

a factorizer configured to apply a matrix factorization onto an autocorrelation or covariance matrix of a synthesis filter function defined by the prediction coefficients to acquire factorized matrices;

a transformer configured to transform the residual signal based on the factorized matrices to acquire a transformed residual signal;

a quantize and encode stage configured to quantize the transformed residual signal to acquire a quantized transformed residual signal and comprising an entropy encoder comprising an input for the prediction coefficients and configured to entropy encode the quantized transformed residual signal with detecting the probability based on the prediction coefficients to acquire an encoded quantized transformed residual signal; and an audio data output configured for outputting the audio data stream formed by the prediction coefficients and the encoded quantized transformed residual signal.

2. The encoder according to claim 1, wherein the synthesis filter function is defined by a matrix comprising weighted values of the synthesis filter function.

3. The encoder according to claim 1, wherein the factorizer calculates the autocorrelation or covariance matrix based on the product of a transformed-conjugated version of the synthesis filter function and a regular version of the synthesis filter function.

4. The encoder according to claim 1, wherein the factorizer factorizes the autocorrelation or covariance matrix based on the formula C=V*DV or based on the formula R=V*DV;

wherein V is the Vandermonde matrix, V* the transformed-conjugated version of the Vandermonde matrix and D a diagonal matrix with strictly positive entries.

5. The encoder according to claim 4, wherein the factorizer is configured to perform a Vandermonde factorization.

6. The encoder according to claim 1, wherein the factorizer is configured to perform an eigen value decomposition or a Cholesky factorization.

7. The encoder according to claim 4, wherein the transformer transforms the residual signal based on the formula $y=D^{1/2}Vx$ or based on the formula y=DVx.

8. The encoder according to claim 1, wherein quantize and encode stage quantizes the transformed residual signal to acquire the quantized transformed residual signal based on an objective function $$\eta(y) = \frac{(y^* \hat{y})^2}{\|\hat{y}\|^2}.$$

9. The encoder according to claim 1, wherein the quantize and encode stage comprises an optimizer for optimizing the quantizing by applying noise filling to provide a noise-filled spectral representation of the audio signal, the residual signal or the transformed residual signal and or by optimizing the quantized transformed residual signal regarding dead-zones or regarding other quantization parameters.

10. The encoder according to claim 1, wherein the transformation of the residual signal is a transformation from a time-domain of the residual signal to a frequency-like domain of the transformed residual signal.

11. The encoder according to claim 1, wherein the quantize and encoding stage comprises an coder configured to perform an encoding of the quantized transformed residual signal to acquire an encoded quantized transformed residual signal.

12. The encoder according to claim 11 wherein the encoding performed by the coder is out of a group comprising arithmetic coding.

13. The encoder according to claim 11, wherein the encoder further comprises a packer configured to packetize the encoded quantized transformed residual signal and the prediction coefficients to the data stream to be output by the encoder.

14. The encoder according to claim 1, wherein the predictor comprises a linear predictor or a long time predictor.

15. A method for audio encoding an audio signal into an audio data stream, the method comprising:

analyzing the audio signal in order to acquire prediction coefficients describing the spectral envelope of the audio signal or a fundamental frequency of the audio signal and subjecting the audio signal to an analysis filter function dependent on the prediction coefficients in order to output a residual signal of the audio signal;

applying a matrix factorization onto an autocorrelation or covariance matrix of a synthesis filter function defined by the prediction coefficients to acquire factorized matrices;

transforming the residual signal based on the factorized matrices to acquire a transformed residual signal;

quantizing and encoding the transformed residual signal to acquire a quantized transformed residual signal and entropy encoding using the prediction coefficients the quantized transformed residual signal with detecting the probability based on the prediction coefficients to acquire an encoded quantized transformed residual signal; and outputting the audio data stream formed by the prediction coefficients and the encoded quantized transformed residual signal.

16. A method for signal processing, the method comprising: discrete Fourier transformation, discrete cosine transformation, modified discrete cosine transformation or another transformation in signal processing algorithms using the substeps of:

analyzing the audio signal in order to acquire prediction coefficients describing the spectral envelope of the audio signal or a fundamental frequency of the audio signal and subjecting the audio signal to an analysis filter function dependent on the prediction coefficients in order to output a residual signal of the audio signal;

applying a matrix factorization onto an autocorrelation or covariance matrix of a synthesis filter function defined by the prediction coefficients to acquire factorized matrices;

transforming the residual signal based on the factorized matrices to acquire a transformed residual signal; and quantizing and encoding the transformed residual signal to acquire a quantized transformed residual signal and entropy encoding using the prediction coefficients the quantized transformed residual signal with detecting the probability based on the prediction coefficients to acquire an encoded quantized transformed residual signal.

17. An audio decoder for decoding an audio data stream into an audio signal, comprising:

a decode stage configured to output a transformed residual signal based on an inbound encoded quantized transformed residual signal using entropy decoding with detecting the probability based on prediction coefficients describing a spectral envelope of the audio signal or a fundamental frequency of the audio signal;

a retransformer configured to retransform a residual signal from the transformed residual signal based on factorized matrices representing a result of a matrix factorization of an autocorrelation or covariance matrix of a synthesis filter function defined by the prediction coefficients;

a synthesis stage configured to synthesize the audio signal based on the residual signal by using the synthesis filter function defined by the prediction coefficients; and an output configured to output the synthesized audio signal.

18. The decoder according to claim 17, wherein the decoder comprises a factorizer configured to apply the matrix factorization onto the autocorrelation or covariance matrix of the synthesis filter function defined by inbound prediction coefficients to acquire factorized matrices.

19. The decoder according to claim 17, wherein the decoder comprises a prediction coefficients-generator configured to deviate the prediction coefficients based on inbound factorized matrices.

20. The decoder according to claim 17, wherein the decode stage performs the decoding based on known encoding rules or encoding parameter deviated from inbound coding rules or coding parameter.

21. A method for audio decoding an audio data stream into an audio signal, the method comprising:

outputting a transformed residual signal based on an inbound encoded quantized transformed residual signal using entropy decoding with detecting the probability based on prediction coefficients describing a spectral envelope of the audio signal or a fundamental frequency of the audio signal;

applying a matrix factorization onto an autocorrelation or covariance matrix of a synthesis filter function defined by prediction coefficients; describing a spectral envelope of the audio signal or a fundamental frequency of the audio signal to acquire factorized matrices;

retransforming a residual signal from the retransformed residual signal based on the factorized matrices;

synthesizing the audio signal based on the residual signal by using the synthesis filter function defined by the prediction coefficients; and outputting the synthesized audio signal.

22. A non-transitory digital storage medium having stored thereon a computer program for performing a method for audio encoding an audio signal into an audio data stream, the method comprising:

analyzing the audio signal in order to acquire prediction coefficients describing the spectral envelope of the audio signal or a fundamental frequency of the audio signal and subjecting the audio signal to an analysis filter function dependent on the prediction coefficients in order to output a residual signal of the audio signal;

applying a matrix factorization onto an autocorrelation or covariance matrix of a synthesis filter function defined by the prediction coefficients to acquire factorized matrices;

transforming the residual signal based on the factorized matrices to acquire a transformed residual signal;

quantizing and encoding the transformed residual signal to acquire a quantized transformed residual signal and entropy encoding using the prediction coefficients the quantized transformed residual signal with detecting the probability based on the prediction coefficients to acquire an encoded quantized transformed residual signal; and outputting the audio data stream formed by the prediction coefficients and the encoded quantized transformed residual signal, when said computer program is run by a computer.

23. A non-transitory digital storage medium having stored thereon a computer program for performing a method for audio decoding an audio data stream into an audio signal, the method comprising:

outputting a transformed residual signal based on an inbound encoded quantized transformed residual signal using entropy decoding with detecting the probability based on prediction coefficients describing a spectral envelope of the audio signal or a fundamental frequency of the audio signal;

applying a matrix factorization onto an autocorrelation or covariance matrix of a synthesis filter function defined by prediction coefficients; describing a spectral envelope of the audio signal or a fundamental frequency of the audio signal to acquire factorized matrices;

retransforming a residual signal from the retransformed residual signal based on the factorized matrices;

synthesizing the audio signal based on the residual signal by using the synthesis filter function defined by the prediction coefficients; and outputting the synthesized audio signal, when said computer program is run by a computer.

* * * * *